US007510809B2

(12) United States Patent
Yamane et al.

(10) Patent No.: US 7,510,809 B2
(45) Date of Patent: Mar. 31, 2009

(54) ELECTROPHOTOGRAPHIC PHOTORECEPTOR WITH TWO LAYER CHARGE TRANSFER LAYER, AND APPARATUS UTILIZING THE SAME

(75) Inventors: Chigusa Yamane, Hachioji (JP); Keiichi Inagaki, Hino (JP); Kunihiro Ogura, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 367 days.

(21) Appl. No.: 11/285,415

(22) Filed: Nov. 21, 2005

(65) Prior Publication Data

US 2006/0216621 A1 Sep. 28, 2006

(30) Foreign Application Priority Data

Mar. 22, 2005 (JP) ..... 2005-081777

(51) Int. Cl.
*G03G 5/047* (2006.01)
*G03G 5/06* (2006.01)

(52) U.S. Cl. ..... 430/58.45; 430/58.75; 430/58.8; 430/59.6; 430/58.65; 430/58.4

(58) Field of Classification Search ..... 430/59.6, 430/58.05, 58.65, 58.85, 58.4, 58.45
See application file for complete search history.

(56) References Cited

U.S. PATENT DOCUMENTS 6,127,077 A * 10/2000 Pai et al. ..... 430/58.7
6,156,466 A * 12/2000 Tamura et al. ..... 430/57.3
6,379,853 B1 * 4/2002 Lin et al. ..... 430/58.45
6,661,985 B2 12/2003 Kiyohara et al.
6,824,940 B2 11/2004 Wu et al.
6,933,089 B2 * 8/2005 Horgan et al. ..... 430/58.8
6,964,834 B2 11/2005 Ueda et al.
7,033,714 B2 * 4/2006 Horgan et al. ..... 430/58.3
7,041,419 B2 * 5/2006 Tokutake et al. ..... 430/58.2
7,101,648 B2 9/2006 Itami
7,122,284 B2 10/2006 Kawamura et al.
2002/0106570 A1 * 8/2002 Kami et al. ..... 430/58.05
2003/0113642 A1 * 6/2003 Kami et al. ..... 430/57.2

FOREIGN PATENT DOCUMENTS

JP 04058252 A * 2/1992
JP 04321053 A * 11/1992
JP 2002-202621 7/2002
JP 2002-333729 11/2002
JP 2004-77591 3/2004
JP 2004-226883 8/2004
JP 2004-252459 9/2004

OTHER PUBLICATIONS

Diamond, Arthur S & David Weiss (eds.) Handbook of Imaging Materials, 2nd ed., New York: Marcel-Dekker, Inc. (Nov. 2001) pp. 401-407.*
"Impact of conformation on the dipole moment of bis-triarylamine derivatives" to Malagoli et al., Chemical Physical Letters 354, pp. 283-290 (2002).*
"Effect of Substitution on the Hole Mobility of Bis(diarylamino)biphenyl Derivatives Doped in Poly(Styrene)" Maldonado et al., Chemical Materials 15, pp. 994-999 (2003).*
English translation of JP 04-058252 (1992).*
English translation of JP 04-321053 (1992).*
The Office Action issued by JPO on Feb. 2008, in connection with App. No. 2006-039132, 4 pgs.
Translation of Office Action issued by JPO on Feb. 2008, 7 pgs.

* cited by examiner

*Primary Examiner*—Christopher RoDee
(74) *Attorney, Agent, or Firm*—Squire, Sanders & Dempsey L.L.P.

(57) ABSTRACT

An electrophotographic photoreceptor including a charge generating layer and a charge transfer layer accumulated on a support member, the charge transfer layer including at least two layers of a support side layer and a surface side layer, wherein the support side layer contains A mol/cm$^3$ of charge mol/cm$^3$ of charge transfer material having a dipolar moment of not more than 0.75 and inorganic particles having a number average primary particle diameter of 3-150 nm, wherein A and B satisfies relations of (1) and (2), $$9.0\times10^{-4}>A>3.0\times10^{-4} \quad (1)$$

$$8.0\times10^{-4}>B>2.0\times10^{-5} \quad (2).$$

20 Claims, 2 Drawing Sheets

ELECTROPHOTOGRAPHIC PHOTORECEPTOR WITH TWO LAYER CHARGE TRANSFER LAYER, AND APPARATUS UTILIZING THE SAME

BACKGROUND OF THE INVENTION

The present invention relates to an electrophotographic photoreceptor; an image forming method and an image forming apparatus and a process cartridge utilizing the same.

In recent years, an organic photoreceptor is widely utilized as an electrophotographic photoreceptor. An organic photoreceptor, in contrast to other photoreceptors, is provided with advantageous points of enabling such as easy development of materials corresponding to various types of exposure light sources from visible light to infrared light, selection of materials without environmental pollution, and lower manufacturing cost. However, disadvantages are problems of deterioration of electrostatic characteristics of a photoreceptor and generation of abrasion on the surface of the photoreceptor, at the time of making a large number of copies, due to poor mechanical strength and chemical durability.

That is, since the surface of a photoreceptor is directly applied with electrical and mechanical external forces by such as a charging device, a developing section, a transferring section and a cleaning section, resistance against them is required for said photoreceptor.

Specifically, there has been required improvement of resistance to generation of abrasions and flaws on the photoreceptor surface and to deterioration of the surface due to active oxygen such as ozone, and nitrogen oxide, which are generated at corona charging.

To solve the problems of mechanical and chemical durability such as described above, many organic photoreceptors employ an accumulated constitution comprising a charge generating layer and a charge transfer layer, the charge transfer layer at the surface layer being comprised of a uniform layer, which has high strength as well as minimum permeability of an active gas and provided with a layer thickness of not less than 20 μm.

However, since it is not advantageous for maintaining high image quality when a charge transfer layer is made to be too thick, heretofore, already proposed has been an organic photoreceptor, in which a charge transfer layer is made thinner to prevent diffusion of an electrostatic latent image, in such as JP-A No. 5-119503 (hereinafter, JP-A refers to Japanese Patent Publication Open to Public Inspection). However, these proposed organic photoreceptors still have not sufficiently answered the requirements of durability of a photoreceptor and higher quality images.

As a method to improve anti-abrasion characteristics of an organic photoreceptor, in addition to a protective layer utilizing curable silicone resin, there is described, in JP-A Nos. 56-117245, 63-91666 and 1-205171, that durability can be improved by incorporating silica particles in the outermost surface layer of a photoreceptor to increase mechanical strength of the photoreceptor surface. Further, in such as JP-A Nos. 57-176057 and 61-117558, and Patent literature 1, described is that a photoreceptor having higher durability is obtained by incorporating hydrophobic silica particles, which is comprised of the aforesaid silica particles having been subjected to a treatment by such as a silane coupling agent, in the outermost surface layer of a photoreceptor to increase mechanical strength of the photoreceptor as well as to provide a photoreceptor with lubricity.

However, in these abrasion resistance improvement techniques, there is observed a tendency of deterioration in image quality, particularly, in sharpness when repeated image formation is performed to provide many sheets of copied images.

Further, a method to incorporate an antioxidant in a charge transfer layer has been studies for many years (for example, refer to patent literature 2).

Further, there are many examples of constituting a charge transfer layer with plural layers to increase physical strength of the charge transfer layer surface while keeping high charging characteristics as a photoreceptor (for example, refer to patent literature 3).

These were effective to improve characteristics of an organic photoreceptor, however, nowadays, the required level of capability improvement with respect to an organic photoreceptor is high and they cannot be said satisfactory in this sense.

On the other hand, for image formation of a digital image having a high resolution, it is necessary to precisely develop a digital dot latent image by making toner adhere on an electrostatic latent image formed on an organic photoreceptor. That is, to form a toner image which faithfully reproduces an electrostatic latent image without spattering of toner on an organic photoreceptor, it is important to make foreign materials not adhere on the organic photoreceptor surface and to make the surface be not roughened even with repeated use.

[Patent Literature 1] JP-A No. 3-155558 (hereinafter, JP-A refers to Japanese Patent Publication Open to Public Inspection)

[Patent Literature 2] JP-A No. 1-106066 [Patent Literature 3] JP-A No. 2-160247

This invention has been made in view of the foregoing problems.

Particularly, by employing all of the above-described improvement techniques, an effect accumulating these techniques cannot necessarily be obtained and even they may cancel functions each other by combination use of these techniques, as a result, it has been proved how to combine these techniques is a big problem. Therefore, the inventors of this invention have studied combinations of various durability improvement techniques, which are suitable to provide an electrophotographic photoreceptor which maintains high sensitivity and mechanical strength even in a long term use as well as gives stable charging potential, without image flows and deterioration against gas.

SUMMARY OF THE INVENTION

An object of this invention is to provide an electrophotographic photoreceptor, which can maintain high sensitivity and mechanical strength even in a long term use, as well as gives stable charging voltage without an image flow and deterioration against gas, an image forming apparatus and a process cartridge utilizing the same.

The inventors of this invention, as a result of an extensive study, have found that, by making a charge transfer layer, in an accumulated layer type photoreceptor, have a constitution comprising at least two layers, and by setting the dipolar moment (Dp) and concentration of a charge transfer material contained in a charge transfer layer of the lower layer side (the support side), and the dipolar moment (Dp) and concentration of a charge transfer material contained in a charge transfer layer of the upper layer side (the surface side) to a specific combination, an electrophotographic photoreceptor which can be provided with high mechanical strength in addition to high sensitivity, as well as high gas resistance without an image flow, whereby this invention has been achieved.

That is, an object of this invention is achieved by the following constitutions.

An aspect of the invention can be an electrophotographic photoreceptor comprising a charge generating layer and a charge transfer layer on a support, the charge transfer layer including at least two layers of a support side layer and a surface side layer, wherein the support side layer contains A mol/cm$^3$ of a charge transfer material, and the surface side layer contains B mol/cm$^3$ of a charge transfer material having a dipolar moment of not more than 0.75, and inorganic particles having a number average primary particle diameter of 3-150 nm, wherein A and B satisfies relations of (1) and (2), $$9.0\times10^{-4}>A>3.0\times10^{-4} \quad (1)$$

$$8.0\times10^{-4}>B>2.0\times10^{-5} \quad (2).$$

DETAILED DESCRIPTION OF THE PREFERRED EMBODIMENT

Figure 1:
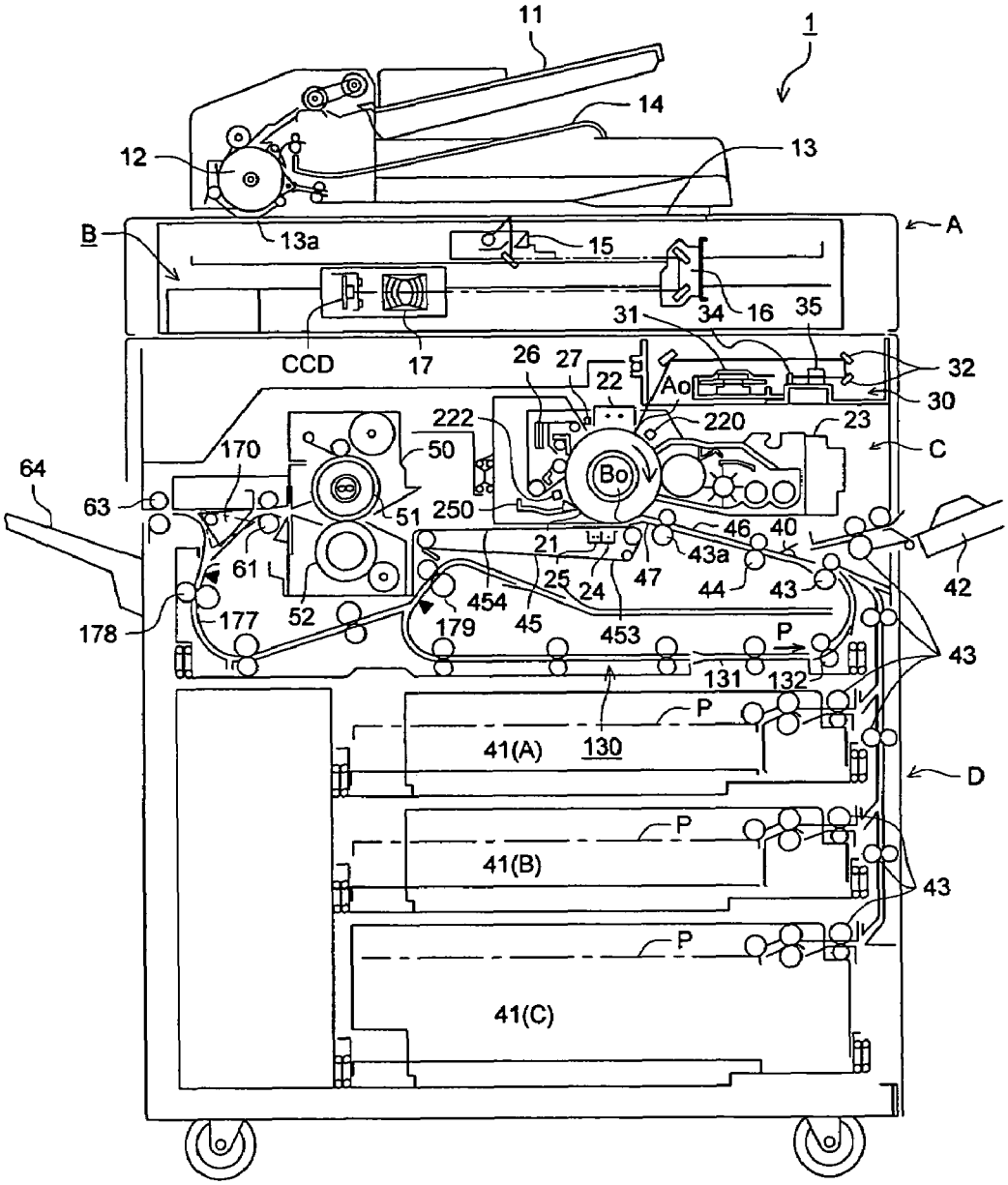
FIG. 1 is a cross-sectional view of an image forming apparatus based on a digital mode.

The reason, why an object of this invention can be achieved by the above constitution, is considered as follows.

Resistance of a photoreceptor against chemical substances such as ozone and $NO_x$ can be enhanced by incorporating a charge transfer material having a relatively small dipolar moment (Dp) at a not too high concentration, and durability against mechanical stress by incorporating inorganic particles in the charge transfer layer on the surface side. Further, image formation, exhibiting a high sensitivity and an excellent image quality, becomes possible by incorporating a charge transfer material at a high concentration in the lower charge transfer layer. Therefore, it is estimated that, by utilizing the above both techniques in combination, prepared can be an electrophotographic photoreceptor provided with a high sensitivity and a high image quality as well as being strong against both of mechanical and chemical influences, that is, having well-balanced characteristics.

When A becomes larger than $9.0\times10^{-4}$, resistance against chemical gases decreases, amount of residual solvent increases, and stability of electrical potential deteriorates, and when A is less than $3.0\times10^{-4}$, fog images (gray background images) tend to be formed. When B is larger than $8.0\times10^{-4}$, durability of the photoreceptor decreases, and when B is smaller than $2.0\times10^{-5}$, the sensitivity decreases. By satisfying the relations of:

$$9.0\times10^{-4}>A>3.0\times10^{-4} \quad (1)$$

$$8.0\times10^{-4}>B>2.0\times10^{-5} \quad (2)$$

the photoreceptor exhibits a preferable characteristics for high speed color image forming apparatus under high temperature and high humidity condition. And the photoreceptor exhibits well-balanced characteristics of high sensitivity and high image quality, as well as high mechanical and chemical durability.

Further, a charge transfer layer (CTL) on the surface side of this invention may be provided with a covering layer comprising a very thin layer not to disturb the effects of this invention, however, is generally the upper most layer, and a charge transfer layer on the support side indicates a CTL arranged nearer to the support side than the aforesaid CTL. This CTL may be further divided into plural layers, and, for example, in the case of dipolar moment (Dp) of a charge transfer material or a content thereof being compared, it is judged by comparing the value of a CTL on the uppermost layer side with the value of each CTL coated on the support side.

In the following, such as compounds, the constitution of a photoreceptor and an image forming apparatus, which are utilized in this invention, will be further explained.

[Charge Transfer Material (CTM)]

In this invention, charge transfer materials, which can be utilized in a constituent layer on the conductive support side among constituent layers of a charge transfer layer, include the following.

[Chemical Structure 1]

TL-1

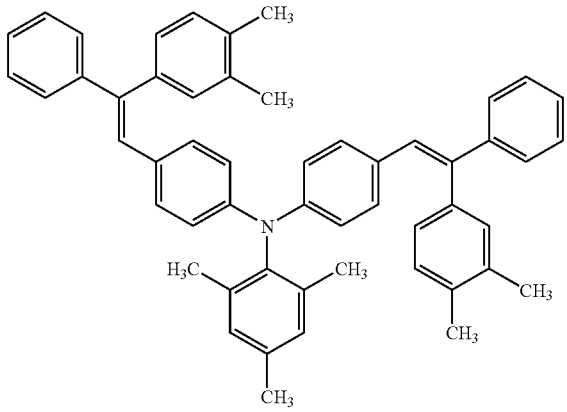

Dp: 0.799

TL-2

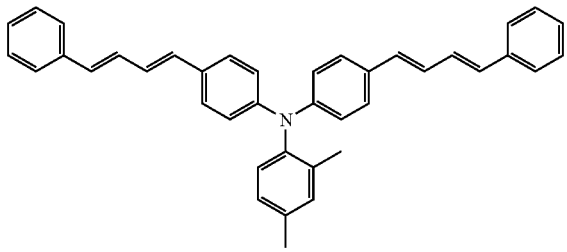

Dp: 0.963

TL-3

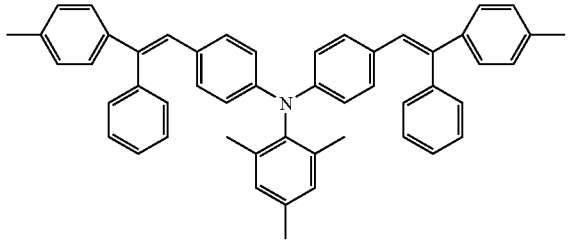

Dp: 0.853

-continued
TL-4
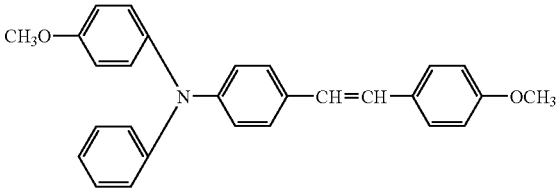
TL-5
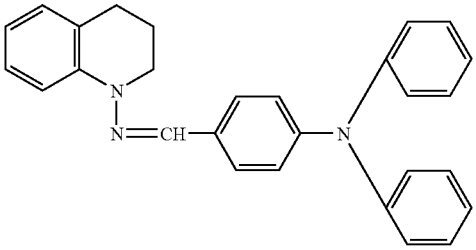
TL-6
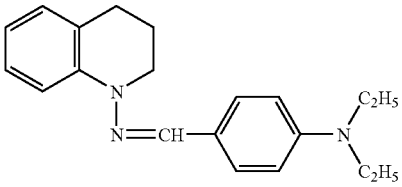
TL-7
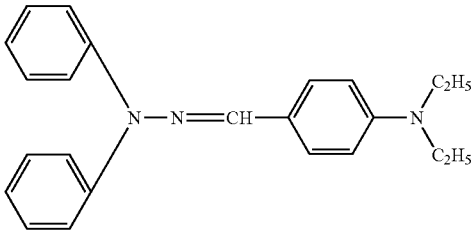
TL-8
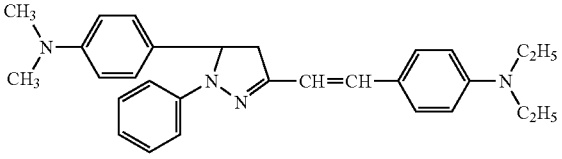
TL-9
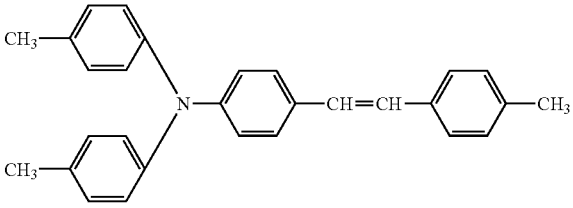
-continued
TL-10
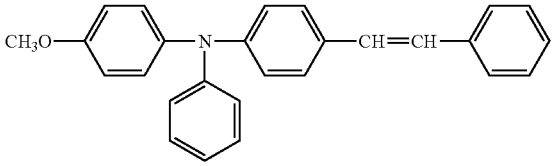
TL-11
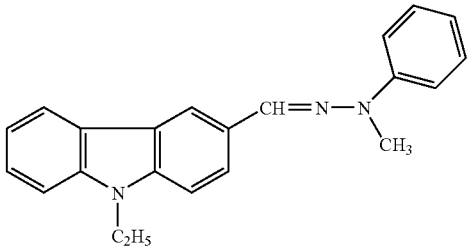
TL-12
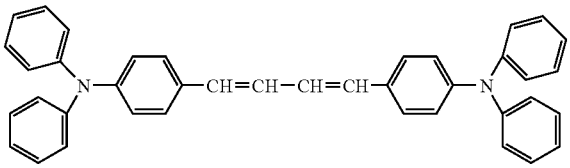
TL-13
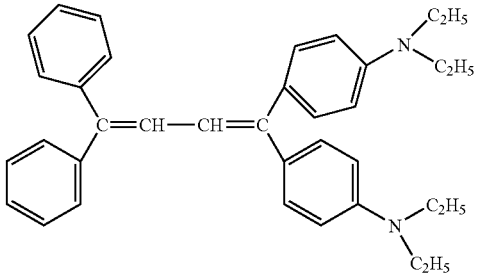
TL-14
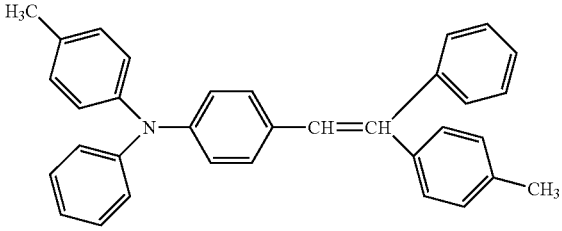
TL-15
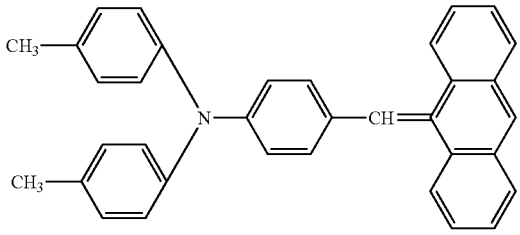

-continued

TL-16

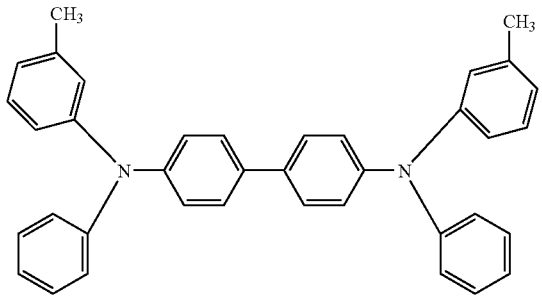

TL-17

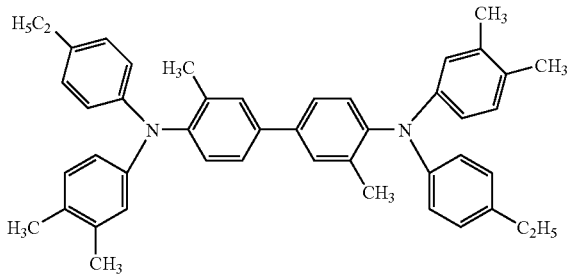

TL-18

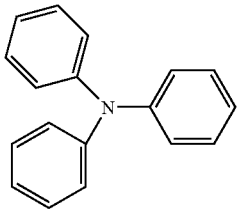

TL-19

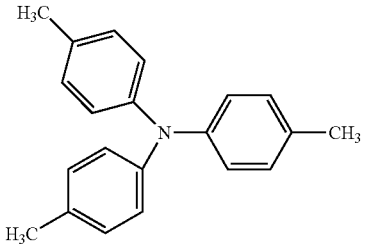

TL-20

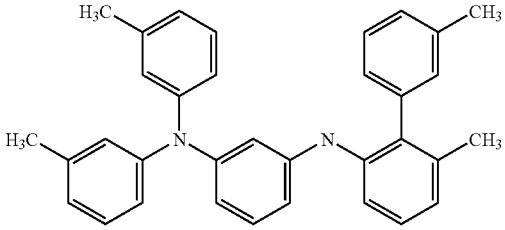

-continued

TL-21

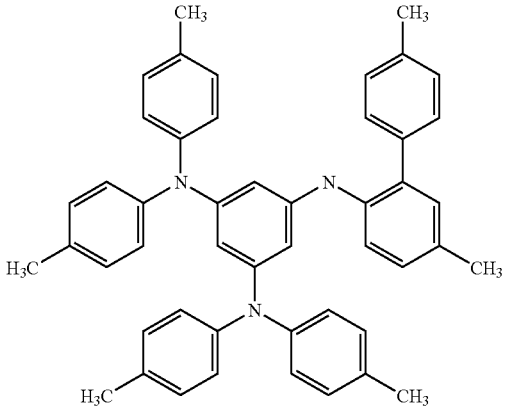

TL-22

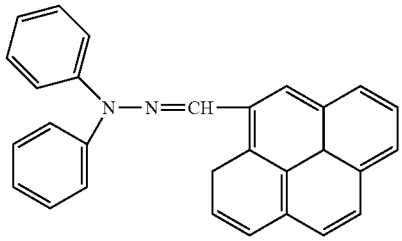

In this invention, as a dipolar moment of a charge transfer material, employed was one calculated by a semi-empirical molecular orbit calculation utilizing a parameter of AMI. The HOMO electron density distribution and the dipolar moment were obtained by utilizing AMI parameter as follows.

That is, the wave function used for Schlodinger equation in molecular orbital method is approximated by the Slater determinant composed of molecular orbits expressed by linear conjugations of atomic orbits. Various physical quantities as total energy, wave function and expectant values of the wave function are calculated by obtaining the molecular orbit constituting the wave function by using an approximation of self-consistent field. When obtaining the molecular orbit by the approximation of self-consistent field, by approximating the time consuming integral calculation with utilizing various empirical values with parameters, the semi-empirical molecular orbit calculation method reduces the time for calculation. In the present invention, AMI parameter set is utilized to calculate with the semi-empirical molecular orbit calculation program MOPAC version MOPAC 93. (Regarding PM3 and MOPAC, refer to J. J. P Stewart, Journal of Computer-Aided Molecular Design, 4, 1 (1990))

Further, a charge transfer material having a dipolar moment of not more than 0.75, which can be utilized in this invention, includes the following. Incidentally, the surface side layer of CTL may contain CTM with dipolar moment greater than 0.75 as well as the CTL with dipolar moment not greater than 0.75. Preferably the ratio of CTM with dipolar moment not more than 0.75 to the total CTM contained in the layer is 50 weight t through 70 weight %, and more preferably is 100 weight %.

[Chemical Structure 2]
TS-1
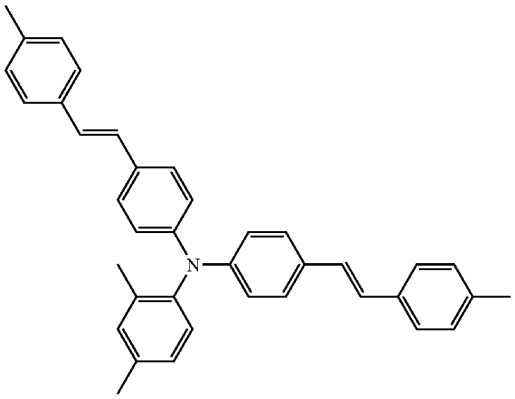
Dp: 0.652
TS-2
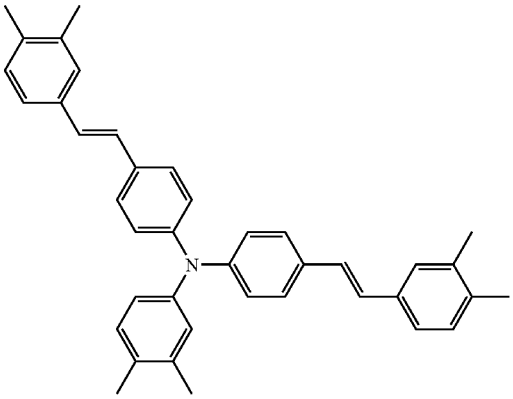
Dp: 0.132
TS-3
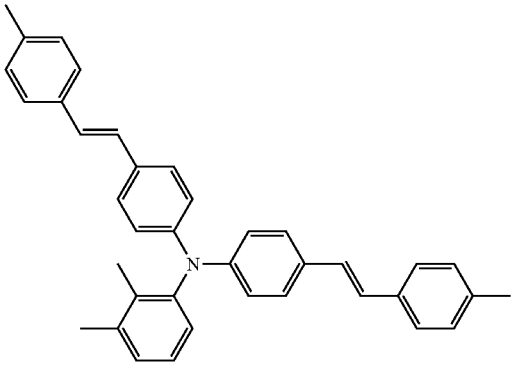
Dp: 0.687
TS-4
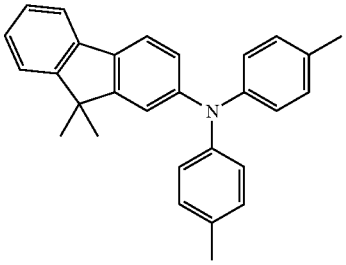
Dp :0.669
TS-5
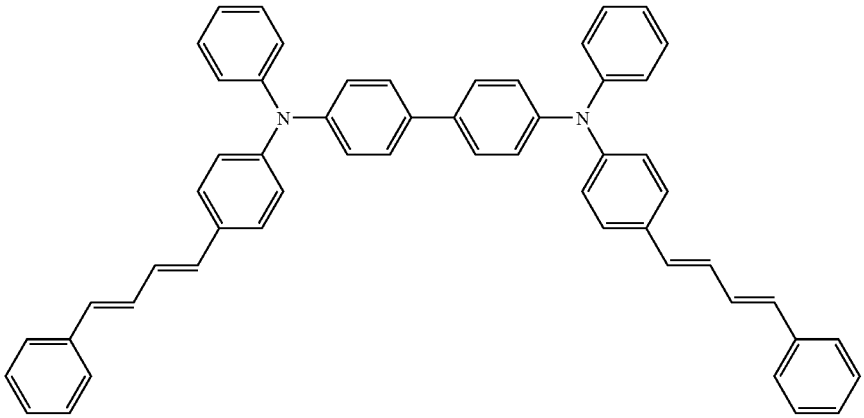
Dp: 0.381

-continued
TS-6
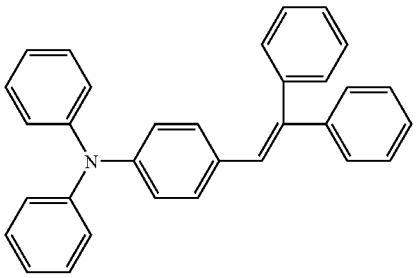
Dp: 0.280
[Chemical Structure 3]
TS-7
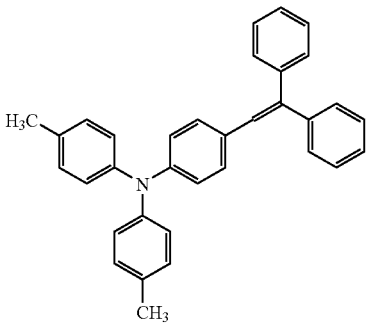
Dp: 0.589
TS-8
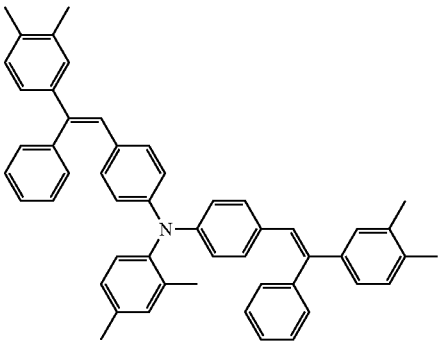
Dp: 0.749
TS-9
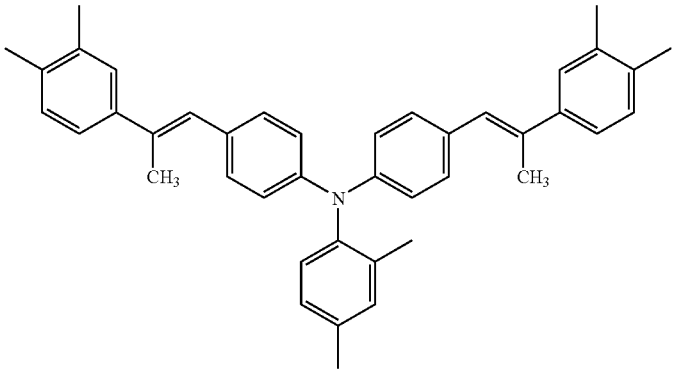
Dp: 0.560
TS-10
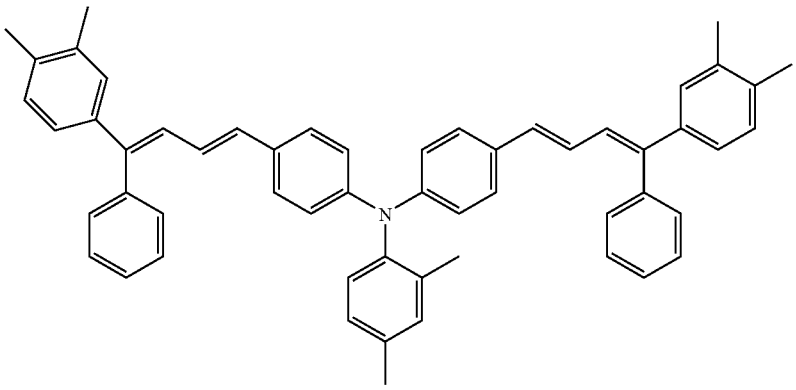
Dp: 0.364

-continued

TS-11

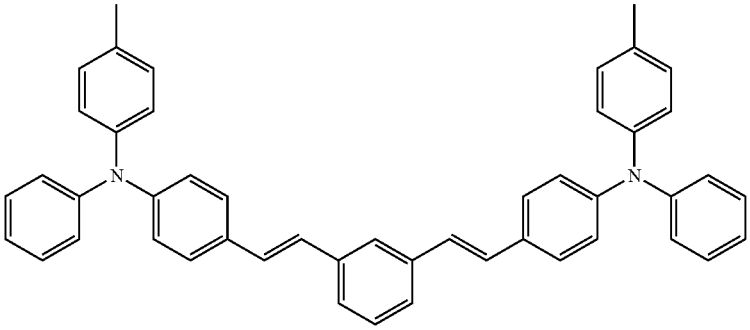

Dp: 0.544

[Inorganic Particles]

Inorganic particles are preferably particles of such as metal oxide (particularly titanium oxide or alumina particles) and silica.

Among silica particles, specifically preferred are silica particles which contain an aluminum component of not more than 1000 ppm, a calcium component of not more than 300 ppm and an iron component of not more than 1000 ppm, or do not contain these components.

In addition to this, inorganic particles utilized in this invention have a number average primary particle size of 3-150 nm, and preferably of 5-100 nm. These inorganic particles are essentially spherical particles and manufactured by a chemical flame CVD method.

To determine a number average primary particle size, randomly selected 300 particles are observed through an electron microscope at a magnification of 10000 times, and the measurement value is calculated as a number average particle size of Feret diameters by image analysis.

Further, as another preferred embodiment, hydrophobic silica particles, which are the aforesaid silica particles having been subjected to a hydrophobicity treatment, are preferably utilized.

The hydrophobicity of the aforesaid hydrophobic silica is preferably not less than 50% based on a hydrophobicity represented by a wettability scale against methanol (methanol wettability). When the hydrophobicity is less than 50%, a creep ratio becomes small as well as the photoreceptor surface is liable to have moisture possibly resulting in residual potential rise or insufficient cleaning. More preferable hydrophobicity is not less than 65% and most preferably not less than 70%.

Reactive organic silicon compounds preferably utilized in the surface treatment include silazane, silane coupling agents and polysiloxane compounds. As said polysiloxane compound, those having a molecular weight of 1000-20000 are generally easily available, and are provided with an excellent black spot prevention function.

In particular, when methylhydrogen polysiloxane is utilized in the final surface treatment, an excellent result can be obtained.

By performing a surface treatment at lest two times, the surface of inorganic particles are uniformly surface covered (treated), and by employing said surface treated titanium oxide, dispersibility of inorganic particles become excellent resulting in enhanced surface strength of a photoreceptor as well as preparation of an excellent photoreceptor without generation of image defects such as black spots.

In this invention, a charge transfer material is also contained in this layer in addition to the inorganic particles, however, the content of inorganic particles is preferably 5-100 weight % with respect to the total weight of a charge transfer material and a binder resin.

Furthermore, as another preferred embodiment, AO (antioxidant) agents are preferably incorporated in the uppermost surface layer of a photoreceptor. Since CTM having dipolar moment not more than 0.75 is comparatively hard to be oxidized, small amount of AO agent or AO agent of small antioxidant effect is enough to be added, therefore it has an advantage that excessive addition of AO agent or side effect of strong AO agent is prevented. The excessive addition of AO agent causes fragile layer, and the strong AO agent causes a degradation of electrophotographic properties to generate gray background (fog) image. By adding the following AO agents as well as utilizing the CTM of the present invention, durability of the photoreceptor is further enhanced.

Preferable AO agents are represented by the following general formulas I-V. Examples of preferable AO agents are shown as the following AO-1-AO-19.

General formula I

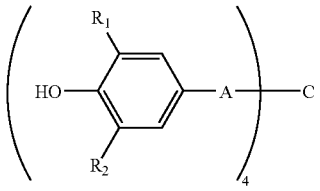

Note: A represents divalent linkage group;

$R_1$, $R_2$ respectively represent alkyl group having carbon number of 1 to 5.

General formula II

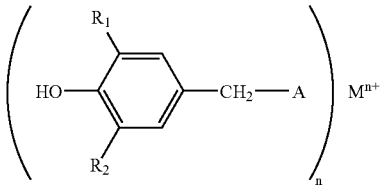

Note: A represents phosphoric acid group;

$R_1$, $R_2$ respectively represent alkyl group having carbon number of 1 to 5;

M represents metallic atom;

n represents integer of 1 to 3.

General formula III

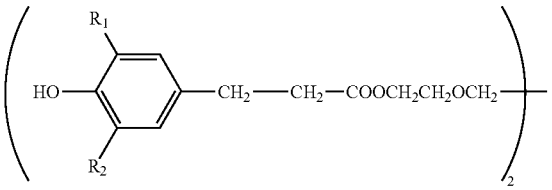

Note: $R_1$, $R_2$ respectively represent alkyl group having carbon number of 1 to 5.

General formula IV

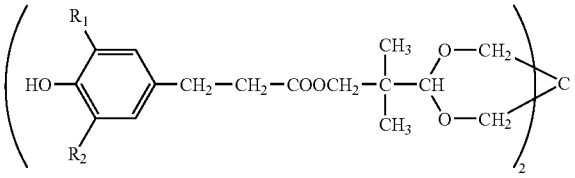

Note: $R_1$, $R_2$ respectively represent alkyl group having carbon number of 1 to 5.

General formula V

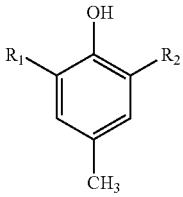

Note: $R_1$, $R_2$ respectively represent alkyl group having carbon number of 2 to 5.

AO-1

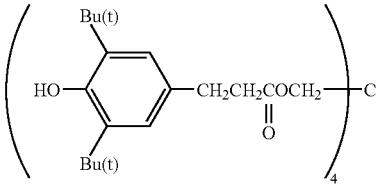

AO-2

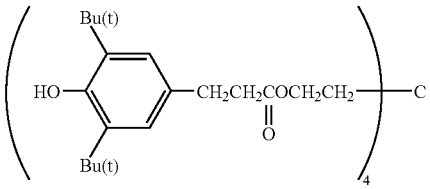

-continued

AO-3

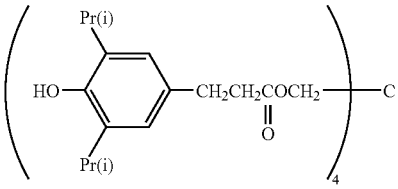

AO-4

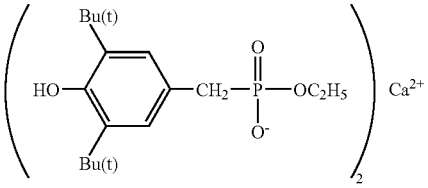

AO-5

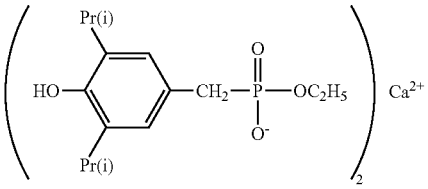

AO-6

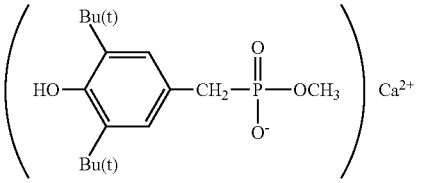

AO-7

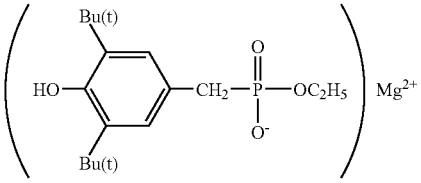

AO-8

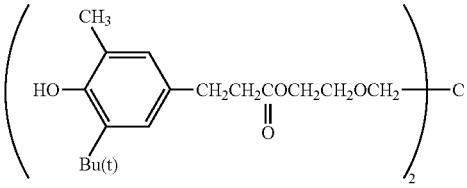

AO-9

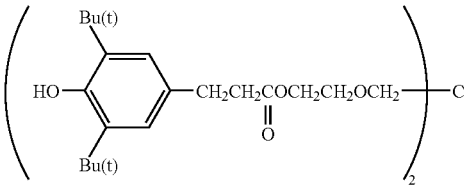

AO-10

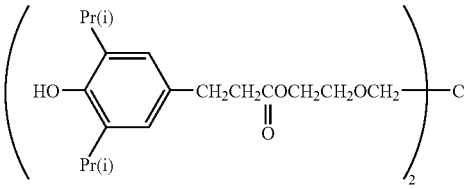

-continued

AO-11

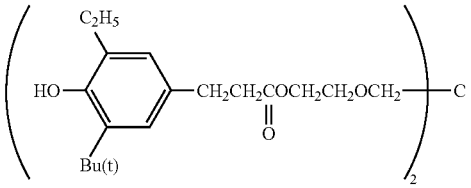

AO-12

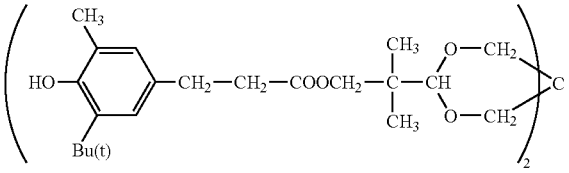

AO-13

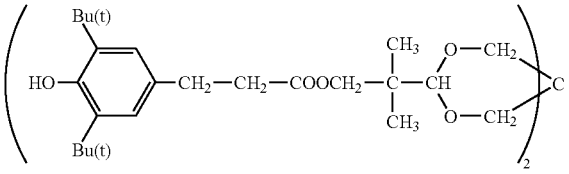

AO-14

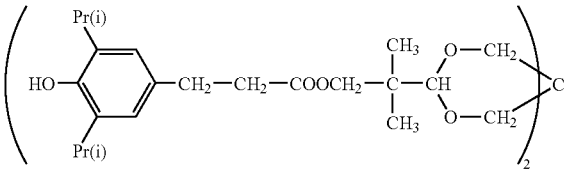

AO-15

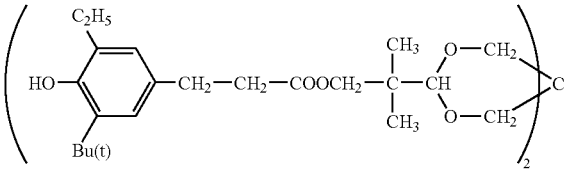

AO-16

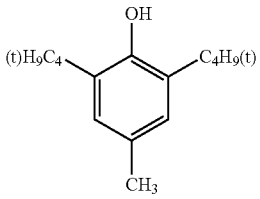

AO-17

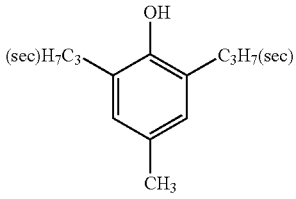

-continued

AO-18

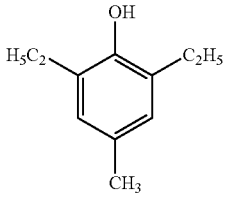

AO-19

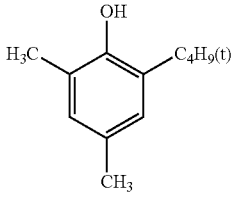

The preferable ratio of AO agent to be added is 5-20 weight % with respect to the CTM. Especially, addition of 0.5-10 weight % of AO agent is preferable. Among the above, AO agent expressed by the general formula V is preferable to cause good color reproduction property under the condition of high temperature with high humidity.

In the following, a photoreceptor utilized in this invention will be further explained.

[Conductive Support]

As a conductive support utilized in a photoreceptor, a sheet form or cylindrical form conductive support can be utilized.

A cylindrical conductive support means a cylindrical support which can form images endless-wise by being rotated, and is preferably a conductive support having a straightness of not more than 0.1 mm and a swing width of not more than 0.1 mm. When the straightness and swing width are over these ranges, good image formation becomes difficult.

As a material for a conductive support, utilized can be metal drums of such as aluminum and nickel; plastic drums evaporated with such as aluminum, tin oxide and indium oxide; or paper plastic drums coated with a conductive substance. A conductive support preferably has a specific resistance at room temperature of not more than $10^3$ Ωcm.

As a conductive support utilized in this invention, utilized may be those on the surface of which an Alumite layer having been sealing treated is formed. An Alumite treatment is generally performed in an acidic bath of such as chromic acid, sulfuric acid, oxalic acid, phosphoric acid, boric acid and sulfamic acid, however, an anodic oxidation treatment in a sulfuric acid provides the most preferable result. In the case of an anodic oxidation treatment in a sulfuric acid, it is preferable to perform the treatment at a sulfuric acid concentration of 100-200 g/l, an aluminum ion concentration of 1-10 g/l, a solution temperature of approximately 20° C. and an applied voltage of approximately 20 V, however, the conditions are not limited thereto. Further, a mean layer thickness of an anodic oxidation covering layer is generally not more than 20 μm and specifically preferably not more than 10 μm.

[Intermediate Layer (Under-Coat Layer)]

In this invention, an intermediate layer provided with a barrier function is preferably provided between a conductive support and a photoreceptor layer.

In an intermediate layer of this invention, titanium oxide is preferably incorporated in a binder resin. A mean particle size of said titanium oxide is preferably in a range of 10-400 nm and specifically preferably 15-200 nm based on a number average primary particle size. An intermediate layer coating solution utilizing titanium oxide particles having a number average particle size in the aforesaid range is good in dispersion stability, and an intermediate layer formed from such a coating solution is excellent in environmental characteristics in addition to black spot prevention function.

[Photosensitive Layer]

Charge Generating Layer (CGL)

On a conductive support or on an intermediate layer coated thereon, coated is a charge generating layer (CGL). A charge generating material (CGM) is contained in a charge generating layer. In addition to this, binder resin and other additives may be appropriately incorporated.

In an organic photoreceptor of this invention, as a charge generating material, such as phthalocyanine pigment, azo pigment, perylene pigment and azulenium pigment can be utilized alone or in combination.

In the case of utilizing a binder as a dispersion medium of a CGM in a charge generating layer, resin well known in the art can be utilized as the binder. The most preferable resin includes such as formal resin, butyral resin, silicone resin, silicone modified butyral resin and phenoxy resin. The ratio of binder resin to a charge generating material is preferably 20-600 weight parts to 100 parts of binder resin. By utilizing these resins, the increase of residual potential accompanied with repeated use can be minimized. The layer thickness of a charge generating layer is preferably 0.1-2 μm.

Charge Transfer Layer (CTL)

On the above-described charge generating layer, in this invention, at least two layers of charge transfer layers (CTL) are provided.

A charge transfer material (CTM) contained in a charge transfer layer has been described before.

Binder resin contained in a CTL in the case of the aforesaid accumulated layer constitution includes such as polyester resin, polystyrene resin, methacrylic resin, acrylic resin, polyvinyl chloride resin, polyvinylidene chloride resin, polycarbonate resin, polyvinyl butyral resin, polyvinyl acetate resin, styrene-butadiene resin, vinylidene chloride-acrylonitrile copolymer resin, vinyl chloride-maleic anhydride copolymer resin, urethane resin, silicone resin, epoxy resin, silicone-alkid resin, phenol resin, polysilane resin and polyvinylcarbazole.

Binder resin contained in a CTL is preferably those which are strong against mechanical shock and have large abrasion resistance as well as does not disturb electrophotographic characteristics. Specifically preferable binder resin includes polycarbonate resin provided with a structural unit represented by following general formulas [I]-[IV]. Especially, for the uppermost layer, the resin represented by general formula [I] is preferably used, which has low permeability to degrading gases such as ozone and NOx and has good anti-abrasion property. As for the under layer, resins represented by the general formulas [II]-[IV] are preferably used, which have low retaining property of residual solvent.

[Chemical Structure 4]

General formula (I)

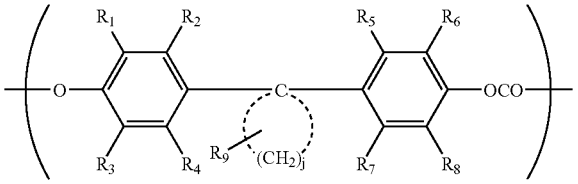

(wherein, $R_1$—$R_8$ represent a hydrogen atom, a halogen atom; an alkyl group, cycloalkyl group or an aryl group, which may be substituted or unsubstituted and having a carbon number of 1-10; j represents an integer of 4-11, and $R_9$ is an alkyl group or an aryl group, having a carbon number of 1-9.)

[Chemical Structure 5]

General formula (II)

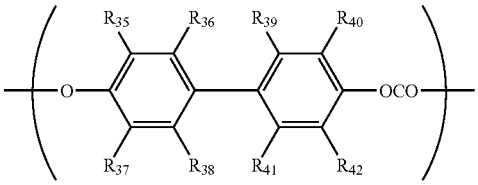

(wherein, $R_{35}$—$R_{42}$ each independently represent a hydrogen atom, a halogen atom, an alkyl group or aryl group.)

[Chemical Structure 6]

General formula (III)

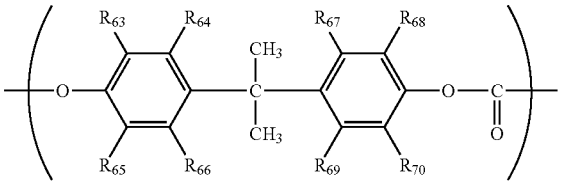

(wherein, $R_{63}$—$R_{70}$ each independently represent a hydrogen atom, a halogen atom; an alkyl group, cycloalkyl group or an aryl group, which may be substituted or unsubstituted and having a carbon number of 1-10.)

[Chemical Structure 7]

General formula (IV)

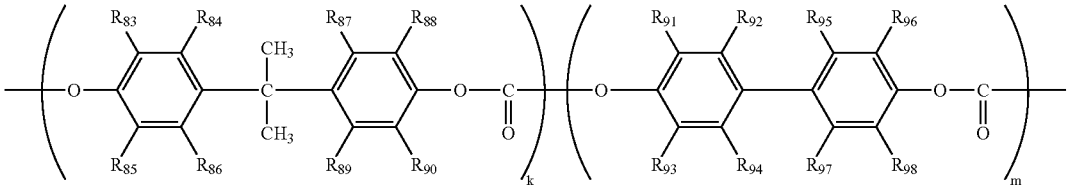

(wherein, $R_{83}$—$R_{98}$ each independently represent a hydrogen atom, a halogen atom; an alkyl group or an aryl group, which may be substituted or unsubstituted; and k and m is a positive integer being selected so as to make k/m of 1-10.)

Herein, polycarbonate resin having a structural unit represented by the aforesaid general formula is preferably provided with a weight average molecular weight of not less than 30,000.

Next, solvents or dispersion media utilized at the time of forming the aforesaid each layer include such as n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxane, methanol, ethanol, isopropanol, ethyl acetate, butyl acetate, dimethyl sulfoxide and methyl cellosolve. This invention is not limited thereto, however, when a ketone type solvent is utilized, such as sensitivity and potential variation at repeated use becomes further better. Further, these solvents may be utilized alone or as a mixed solvent of at least two types.

Further, each charge transfer layer is formed by dissolving a charge transfer material and binder resin in a suitable solvent and coating said solution followed by drying. The mixing ratio of a charge transfer material to binder resin is preferably 3/1-1/3 and specifically preferably 2/1-1/2, based on a weight ratio.

Further, a total layer thickness of all charge transfer layers is preferably 5-50 μm and specifically preferably 10-40 μm.

[Developing Method and Developer]

A dry developing method can be utilized in this invention, and, at present, a two-component developing method, which employs a carrier and a toner, is most popularly utilized. Other than this, a one-component magnetic developing method and a one-component non-magnetic developing method are also utilized, and either of them can be applied in this invention.

And, either method utilizes a powder toner having a particle size of approximately 2-15 μm, and the primary constituent components of the toner are binder resin (binding resin) and a colorant. In this invention, binder resin (binding resin) and a colorant are not specifically limited, and utilized can be those well known in the art in addition to binder resins and colorants generally utilized.

In this invention, in the case that there is a concern for causing poor transfer due to long term use of a photoreceptor, lubricant such as fatty acid metal salt is preferably incorporated in a toner. As fatty acid metal salt, preferred is metal salt of saturated or unsaturated fatty acid having generally a carbon number of not less than 10.

For example, listed are aluminum stearate, indium stearate, potassium stearate, zinc stearate, lithium stearate, magnesium stearate, sodium stearate, aluminum palmitate and aluminum oleate. Specifically preferred is metal salt of stearic acid.

In the case of incorporating fatty acid metal salt in a developer (toner), it is preferable to disperse fatty acid metal salt by being mixed and stirred in a toner after post treatment of the toner. The addition amount depends on such as a particle size of a toner, however generally, is preferably 0.01-1.0 weight % when median diameter D50 in terms of volume distribution is 2-15 μm.

Further, inorganic particles or organic particles are preferably added and mixed in a toner, with respect to providing the toner with fluidity. In this case, inorganic particles are preferably utilized, and particularly, such as silica, titanium oxide and alumina are preferred. Further, inorganic particles are preferably having been subjected to a hydrophobicity treatment by such as a silane coupling agent and a titanium coupling agent.

[Image Forming Apparatus]

Next an image forming apparatus utilizing an organic photoreceptor of this invention will be explained.

FIG. 1 is a cross-sectional view of image forming apparatus 1, which is an image forming apparatus based on a digital mode and constituted of image reading section A, image processing section B, image forming section C and transfer paper transporting section D as a transfer paper transporting section.

An automatic original feeding section to automatically transport an original is arranged on image reading section A, and originals mounted on original stocking table 11 are sent while being separated one by one by original transport roller 12 to perform image reading at reading position 13*a*. An original having finished reading is sent out onto original feed out tray 14 by original transport roller 12.

On the other hand, an image of an original, in the case of being placed on platen glass 13, is read by a reading operation at rate v of first mirror unit 15, which is comprised of an illumination lump and the first mirror, and by transfer of the second mirror unit 16, which is comprised of the second mirror and the third mirror arranged in a V-letter form, at rate v/2 toward the same direction; wherein said first mirror unit 15 and second mirror unit 16 are constituting a scanning optical system.

The image having been read is focused through projection lens 17 on the receptor surface of a photographing element CCD as a line sensor. A line form optical image focused on a photographing element CCD, after having been successively opto-electronically converted into electrical signals (illuminance signals), being subjected to A/D conversion, and to processing such as density conversion and a filtering treatment, and the image data is once memorized in a memory.

In image forming section C, as an image forming unit, drum form photoreceptor 21 as an image carrying member, on the outer circumference thereof, charging device 22 (being also a charger) of a contact mode by a roller which charges said photoreceptor outer circumference, potential detection section 220 to detect the surface potential of a charged photoreceptor, developing section 23, transferring transport belt device 45 as a transfer section (being also a transferring device), cleaning section 26 (being also a cleaner) of the aforesaid photoreceptor 21, and PCL (pre-charge lump) 27 as a discharging device each are arranged in the order of movement. A process cartridge can be constituted by combining at least one of these and photoreceptor 21, which is a preferred embodiment of this invention. These process cartridges can be mounted so as to be easily taken in and out (possible to be taken in and out) from an image forming apparatus.

Further, reflective density detection section 222, to measure a reflective density of a patch image developed on photoreceptor 21, is provided on the down stream side of developing section 23. In photoreceptor 21, an organic photoreceptor of this invention is utilized and is driving rotated clockwise as described in the drawing.

Rotating photoreceptor 21, after having been uniformly charged by charging device 22, is image-wise exposed based on image signals read out by exposure optical system 30 as an image exposing section (being also an image exposing device) from the memory in image processing section B. Exposure optical system 30 as an image exposing section, which is a writing section, employs a laser diode as a light source, although being not shown in the drawing, and a primary scanning is performed by the light pass being bent by reflection mirror 32 via rotating polygon mirror 31, fθ lens 34 and cylindrical lens 35, whereby image-wise exposure is performed at the position of Ao against photoreceptor 21, resulting in electrostatic latent image formation by rotation (vertical scanning) of photoreceptor 21. In an example of the embodiments, an electrostatic latent image is formed by exposure on the letter portion.

In an image forming method of this invention, image-wise exposure is preferably performed by utilizing an exposure beam having a spot area of not more than $2\times10^{-9}$ $m^2$ at the time of forming an electrostatic latent image on a photoreceptor. Even with beam exposure of this small size, a photoreceptor of this invention can faithfully form an image corresponding to said spot area. A more preferred spot area is $0.01\times10^{-9}\times10^{-9}$ $m^2$. As a result, extremely superior image quality, in which 256 gradations are reproduced with not less than 400 dpi (dpi is a dot number per 2.54 cm), can be achieved.

The aforesaid spot area of beam light is expressed by an area corresponding to a peak intensity of said beam light of not less than $1/e^2$.

A utilized light beam includes such as one of a scanning optical system employing a semiconductor laser and a fixed scanner such as a LED and a liquid crystal shutter, and light intensity distribution also includes such as Gauss distribution and Lorentz distribution; however, a spot area is defined as the portion having a peak intensity of not less than $1/e^2$.

An electrostatic latent image on photoreceptor 21 is reversal developed by developing section 23, resulting in formation of a visual toner image on the surface of photoreceptor 21. In transfer paper transport section D, paper feeding units 41(A), 41(B) and 41(C) as a transfer paper storing section, in which different sizes of transfer paper P are stored, are arranged, and manual paper feeding unit 42 is also arranged on the side of D; transfer paper P selected from any one of them is fed along transport path 40 by guide roller 43, being re-fed after having been temporarily stopped, and is guided into paper feeding path 46 and proceeding guide plate 47; a toner image on photoreceptor 21 is transferred onto transfer paper P while being transferring transported on transferring transport belt 454 of transferring transport belt device 45 by transfer electrode 24 and separation electrode 25 at transfer position Bo; and said transfer paper P is separated from the surface of photoreceptor 21 and sent to fixing section 50 by transferring transport belt device 45.

Fixing section 50 (being also a fixing device) is provided with fixing roller 51 and pressure roller 52, toner is fixed with heat and pressure by passing transfer paper P through between fixing roller 51 and pressure roller 52. Transfer paper P after finishing fixing of a toner image is fed out on paper exit tray 64.

In the above, an image formation behavior on the one side of transfer paper was explained; however, in the case of two-sided copying, paper exit switching member 170 is switched to open transfer paper guide section 177 so that transfer paper P is transported toward the dotted arrow head.

Further, transfer paper P is transported downward by transport mechanism 178 to be made be switched back by transfer paper turn-around section 179 resulting in being transported into the inside of two-sided copying paper feeding unit 130 while making the end transport paper P into the top.

Transfer paper P is shifted toward paper feeding direction through transport guide 131 arranged in two-sided copying paper feeding unit 130, and is re-fed by paper feeding roller 132 to guide transfer paper P into transport path 40.

Transfer paper P is transported again toward photoreceptor 21 as described above, a toner image is transferred on the back surface of transfer paper P followed by being fixed with fixing section 50, and then is fed out on feeding out tray 64.

An organic photoreceptor of this invention is generally applied in electrophotographic apparatuses of such as a laser printer, a LED printer and a liquid crystal shutter type printer, a color printer and a full color copier, however, can be also widely applied in apparatuses of such as display, recording, small scale printing, printing plate making and facsimile which apply an electrophotographic technology.

Since a photoreceptor of this invention can stably provide high quality images, it is suitable to be utilized as a full color image forming apparatus such as a full color copier which essentially requires very high durability because of forming one sheet of an image by accumulating images of each basic color.

A full color image forming apparatus will be described below.

Figure 2:
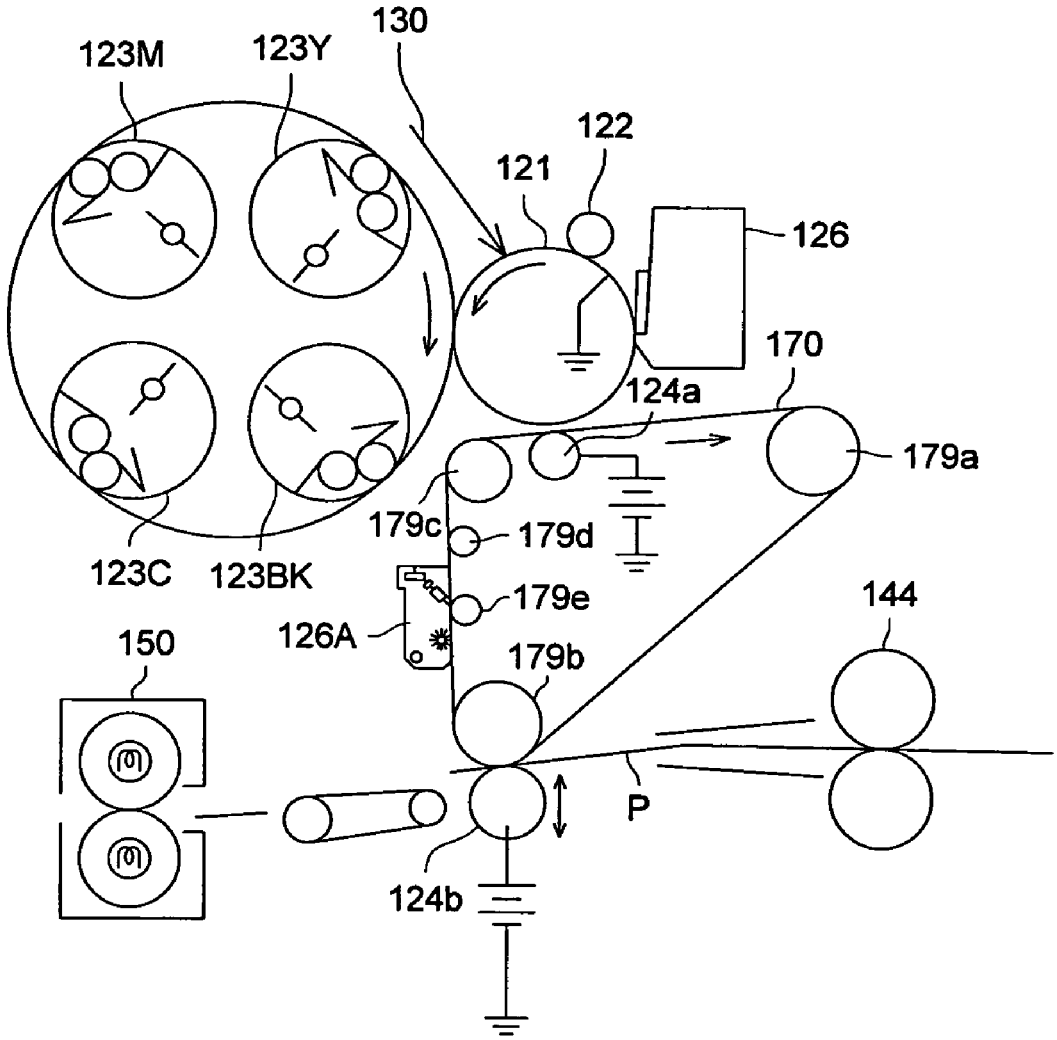
FIG. 2 is a cross-sectional view of a color image forming apparatus.

FIG. 2 is a cross-sectional view of color image forming apparatus utilizing an organic photoreceptor of the present invention (the apparatus is a copier or a laser beam printer having at least charging device, exposing section, plural developing section, transfer section, cleaning section and intermediate transfer member around the organic photoreceptor). As for a belt type intermediate transfer material 110, an elastic member having intermediate electric resistance is used.

Notation 121 shows a rotatable drum type photoreceptor to be repeatedly used as an image forming body, which is driven to rotate in the arrowed direction of counter clockwise with prescribed circumferential velocity.

During the rotation, photoreceptor 121 is charged to a prescribed polarity and potential by charging device 122, and by receiving an image exposure by image exposing section 130 (not illustrated) with a laser beam modulated in response to a sequential digital image signal of the image information. And an electrostatic latent image is formed corresponding to an image of yellow (Y) color component of the image of interest.

Next, the electrostatic image is developed by yellow (Y) developing section 123Y with yellow toner of the first color. During the time, each of the second to fourth developing section (Magenta, Cyan, and Black developing section) 23M, 23C, 23Bk is in off mode and does not operate to photoreceptor 121, namely the yellow toner image of the first color is not affected by the second to fourth developing section.

Intermediate transfer member 170 trained about rollers of 179*a*, 179*b*, 179*c*, 179*d*, and 179*e* is rotated clockwise with the same circumferential velocity as that of photoreceptor 121.

In the process that the yellow toner image of the first color formed and carried on the photoreceptor 121 passes through a nip portion between photoreceptor 121 and intermediate transfer member 170, the yellow toner image is transferred onto the outer circumferential surface (primary transfer) of intermediate transfer member 170 by the electric field formed by a first transfer bias applied to intermediate transfer member 170 from first transfer roller 124*a*.

The surface of photoreceptor 121, corresponding to the yellow toner image of the first color having finished the transfer to intermediate transfer member 170, is cleaned by cleaning device 126.

With the same manner as the above, magenta toner image of the second color, cyan toner image of the third color, and the black toner image of the fourth color are sequentially transferred with superposing onto intermediate transfer member 170, to form the superposed color toner image for the color image of interest.

Secondary transfer roller 124*b* is held with bearings in parallel to secondary transfer counter roller 179*b* with the manner detachable to the surface of intermediate transfer member 170.

Primary transfer bias having opposite polarity to the toner, for sequentially superposing transfer of the toner images of the first through the fourth color from photoreceptor 121 onto intermediate transfer member 170, is applied to primary transfer roller 124*a*. The applied voltage is in a range of +100V to +2 kV, for example.

In the primary transfer process of the first to third color images from photoreceptor 121 onto intermediate transfer member 170, secondary transfer roller 124*b* and cleaning section 126A of intermediate transfer member may be separated from intermediate transfer member 170.

For the transfer of the superposed color toner image on the belt of intermediate transfer member 170 onto transfer member P, which is the second image carrier, while secondary transfer roller 124*b* is pressed to intermediate transfer member 170, the transfer member P is fed in a prescribed timing to the nip portion between intermediate transfer member 170 and secondary transfer roller 124*b* from paired paper feed registration roller 144 through a transfer paper guide. The secondary transfer bias is applied to secondary transfer roller 124*b* from the bias power source. By this secondary transfer bias, the superposed color toner image on intermediate transfer member 170 is transferred (secondary transfer) onto the transfer member as the second image carrier. The toner image transferred on the transfer member P is fed to fixing section 150 and fixed by heat fixing.

EXAMPLES

Next, this invention will be further explained with reference to a typical embodiment. However, the scope of this invention naturally is not limited thereto.

Example 1

<Preparation of Photoreceptor 1-1>.

An intermediate layer, comprising polyamide resin and having a thickness of 0.3 μm, was provided on an aluminum drum having a diameter of 100 mm. Next, a coating solution which was comprised of 30 weight parts of oxytitanium phthalocyanine (CGM-1), which is provided with a peaks at such as 9.5°, 9.7°, 11.6°, 15.0° and 24.1° in addition to the maximum peak at 27.3°, in a X-ray diffraction spectrum employing CuKα characteristic X-ray, 10 weight parts of butyral resin "ESLEC B (BX-L)" (manufactured by Sekisui Chemical Co., Ltd.) and 1600 weight parts of methyl ethyl ketone, was immersion coated on the aforesaid intermediate layer, followed by being dried to form a CGL having a layer thickness of 0.3 μm.

Next, a lower (support side) CTL coating solution was prepared by dissolving 500 weight parts of example compound (TL-1) as a CTM and 600 weight parts of polycarbonate resin "EUPILON Z300" (manufactured by Mitsubishi Gas Chemical Co., Inc.) in 3000 weight parts of a non-halogen type mixed solvent of tetrahydrofuran (THF)/toluene=8/2. Further, an upper (surface layer) CTL coating solution was prepared by dissolving 550 weight parts of example compound (TS-1) as a CTM and 600 weight parts of polycarbonate resin "EUPILON Z800" (manufactured by Mitsubishi Gas Chemical Co., Inc.) in 3000 weight parts of a non-halogen type mixed solvent of tetrahydrofuran (THF)/toluene=8/2, and further being mixing dispersed with 50 weight parts of inorganic particles (silica particles H).

The lower CTL coating solution on the aforesaid CGL and the upper CTL coating solution thereon were simultaneously coated by use of a circular slide hopper coater, whereby photoreceptor 1-1 having each dry layer thickness of 15 μm was prepared.

Preparation Method of Silica Particles H

LPG as an inflammable gas at a flow rate of 3.0 ($N \cdot m^3/h$), and oxygen as an initial combustion supporting gas at a flow rate of 90.0 ($N \cdot m^3/h$), were supplied, and further a carrier gas comprising air, in which metal silica, having a mean particle size of 20 μm and containing an aluminum component of 21.5 ppm, a calcium component of 2.25 ppm and an ion component of 10.8 ppm, were dispersed at a ratio of 35 (kg/h), at a flow rate of 7 ($N \cdot m^3/h$) were supplied, resulting in preparation of silica powder. The obtained silica powder is provided with mixed components of 10 ppm of aluminum and 1 ppm of calcium, and having a mean particle size of 50 nm and a sphericity of (a long axis/a short axis) of 1.0.

(Preparation of Photoreceptors 1-2-1-4 and Comparative Photoreceptors 1-1-1-5)

Photoreceptors 1-2-1-4 and comparative photoreceptors 1-1-1-5 were prepared in a similar manner to example 1 except that the type of a CTM in a CTL and inorganic particles in the photoreceptor were changed as described in table 1.

TABLE 1

| Photoreceptor No. | Base-side | A mol | surface-side | B mol | Silica |
|---|---|---|---|---|---|
| 1-1 | TL-1 | $6.5 \times 10^{-4}$ | TS-5 | $6.4 \times 10^{-4}$ | 50 nm |
| 1-2 | TL-16 | $8.8 \times 10^{-4}$ | TS-10 | $6.7 \times 10^{-4}$ | 50 nm |
| 1-3 | TL-17 | $7.2 \times 10^{-4}$ | TS-11 | $7.4 \times 10^{-4}$ | 50 nm |
| Comp. 1-1 | TL-3 | $6.8 \times 10^{-4}$ | TL-1 | $6.5 \times 10^{-4}$ | 50 nm |
| Comp. 1-2 | TL-14 | $10.1 \times 10^{-4}$ | TS-5 | $6.4 \times 10^{-4}$ | 50 nm |
| Comp. 1-3 | TL-17 | $7.2 \times 10^{-4}$ | TS-2 | $8.9 \times 10^{-4}$ | 50 nm |
| Comp. 1-4 | TL-1 | $6.5 \times 10^{-4}$ | TS-5 | $6.4 \times 10^{-4}$ | Non |
| Comp. 1-5 | TL-1 | $6.5 \times 10^{-4}$ | TS-5 | $6.4 \times 10^{-4}$ | 250 nm |

[Capability Evaluation]

Photoreceptors of 8 types prepared in the above manner were evaluated, by use of Konica 7075 (produced by Konicaminolta Business Technologies Co., Ltd.), which employs laser dot exposure, reversal development, electrostatic transfer, claw separation, a cleaning assisting brush roller and a blade cleaning process, and by being mounted on said copier.

The capability evaluation was performed by practically picturing an original, which includes each ¼ equal part of an letter, a person's face photo, a white solid image or a black solid image, respectively, and by utilizing A4 neutral paper as transfer paper. After making continuous 50,000 copies were made under an outer environment of ordinary temperature and humidity (23° C., 60% RH), the following evaluations were performed.

Evaluation Criteria

<Image Quality>

The above 8 types of prepared photoreceptors are successively mounted to Konica 7075 to form 56,000 images by using an original having halftones. Wherein existence of cleaning failure and image flaws is examined.

A: No cleaning failure or image flaw generation.

B: No cleaning failure or image flaw generation, however, fine flaws are observed on the photoreceptor surface.

C: Cleaning failure is generated and caused image flaw generation.

<Image Density>

The image density was measured by use of RD-918, manufactured by Macbeth Co., as a relative reflection density by setting a reflection density of transfer paper is "0". The evaluation was performed with respect to images after 50,000 copies.

A: The solid black image has a density of not less than 1.2.

B: The solid black image has a density of not less than 1.0.

C: The solid black image has a density of less than 1.0.

<Fog (Judgment with Solid White Images at the Initial and after 50,000 Copies)>

Density of transfer paper (white paper) without being printed was measured at 20 portions as an absolute image density by use of RD-918 produced by Macbeth Co., and an averaged value thereof was designated as a white paper density. Next, white background portion of the transfer paper on which an image had been formed was measured as an absolute image density similarly with respect to 20 portions, and an averaged value thereof minus the aforesaid white paper density was designated as a fog density for evaluation.

A: not more than 0.005 (excellent)

B: not less than 0.005 and not more than 0.01 (level not practically problematic)

C: not less than 0.01 (practically problematic)

<Evaluation of Image Quality>

The 8 types of photoreceptors described before were successively mounted on the above-described copier, and image out puts of 50,000 times were performed by use of a original including a halftone. Meanwhile, evaluations were performed with respect to presence of cleaning failure and presence of image flaws.

<Image Smear>

By observing practically pictured images after 50,000 copies, evaluation was performed as follows: those having no image smear on the both image surfaces were ranked as "A" and those having at least one image smear were ranked as "C".

<Wear Down Amount of Layer Thickness>

The randomly selected 10 points in the uniform layer thickness portion of a photoreceptor were measured, and an average thereof was designated as a layer thickness of the photoreceptor. The layer thicknesses after one copy and after 50,000 copies were measured by use of layer thickness meter EDDY 560C (produced by Helmut Fischer Gmbht Co.), and the difference was designated as a wear down amount of layer thickness.

TABLE 2

| Photoreceptor No. | Image density | Fog | Image quality | Wore amount μm | Image smear |
|---|---|---|---|---|---|
| 1-1 | A | A | A | 0.26 | A |
| 1-2 | A | A | A | 0.24 | A |
| 1-3 | A | A | A | 0.22 | A |
| Comp. 1-1 | C | C | B | 0.26 | C |
| Comp. 1-2 | C | C | B | 0.26 | C |
| Comp. 1-3 | B | C | B | 0.35 | C |
| Comp. 1-4 | B | C | C | 2.80 | C |
| Comp. 1-5 | B | C | C | 1.0 | C |

Note (1):
Evaluations of image density, fog, image quality, and wear out amount were done after 50000 copies were made for each photoreceptor.

Example 2

<Preparation of Photoreceptor 2-1>

Intermediate Layer:

An aluminum drum having a diameter of 100 mm was coated with intermediate layer coating liquid by dip coating method, and dried with 120° C. for 30 min. to form an intermediate layer having 1.0 mm dry thickness. The dispersion liquid described below was diluted double with the same mixing solvent, left at rest over night, and filtered with RIGIMESH filter (MADE BY Nihon Pall Ltd., Filtering accuracy: 5 μm, Pressure: 50 kPa) to form the intermediate coating liquid.

<Preparation of Intermediate Layer Dispersion Liquid>

Binder resin: Polyamide, 1 part (1.00 part per volume);

Rutile type titanium oxide A1 (primary particle diameter, 35 nm; surface treatment was applied with copolymer of methylhydrogen siloxane and dimethyl siloxane (mol ratio, 1:1) of 5 weight % of the titanium oxide A1), 3.5 part (1.0 part per volume);

Ethanol/n-propyl-alcohol/THF (=45/20/30 weight ratio), 10 parts;

Above described materials were mixed and dispersed with the use of sand-mill dispersion machine for 10 hours in batch system to prepare the intermediate layer dispersion liquid.

Charge Generating Layer (CGL):

The ingredients below were mixed and dispersed with sand-mill dispersion machine to prepare the charge generating layer coating liquid. This liquid was coated on the intermediate layer with dip coating method, and formed the CGL of 0.3 μm dry thickness.

| | |
|---|---|
| Titanyl-phthalocyanine pigment (At Bragg angle (2θ ± 0.2 °) of Cu-Kα characteristic X-ray diffraction spectrum, having a maximum diffraction peak at least at 27.3°, and other peaks at 9.5°, 9.7°, 11.6°, 15.0°, and 24.1°) | 20 parts; |
| Silicone modified polyvinyl-butyral | 10 parts; |
| 4-methoxy-4-methyl-2-pentanone | 700 parts; |
| t-butylacetate | 300 parts. |

Under Charge Transfer Layer(CTL):

| | |
|---|---|
| Charge transfer material (TL-1) | 1105 parts |
| Polycarbonate (EUPILON Z300: made by Mitsubishi Gas Chemical Company, Inc.) | 600 parts |
| THF/toluene (weight ratio: 7/3) | 3000 parts |
| Silicone oil (KF-54: made by Shin-Etu Chemical Co., Ltd.) | 1 part |

The above ingredients were mixed and solved to prepare the under CTL coating liquid 2. This coating liquid was coated on the above-described CGL with dip coating method, dried 70 min. with 110° C., and the under layer of CTL having 15.0 μm dry thickness was formed.

Upper Charge Transfer Layer (CTL):

| | |
|---|---|
| Charge transfer material (TS-1) | 469 parts |
| Polycarbonate (EUPILON Z800: made by Mitsubishi Gas Chemical Company, Inc.) | 600 parts |
| THF/toluene (weight ratio: 7/3) | 3000 parts |
| Silicone oil (KF-54: made by Shin-Etu Chemical Co., Ltd.) | 1 part |
| Inorganic particle (silica particle 30 nm) | 50 parts |

The above ingredients were mixed to prepare the upper charge transfer layer coating liquid 2. This coating liquid was coated on the under layer of CTL with circular slide hopper coating method, and the upper layer of CTL having 5.0 μm dry thickness was formed, and the photoreceptor 2-1 was prepared.

<Preparation of Photoreceptor 2-2 through 2-5>

In the above described Example 2, types and amounts of CTM and particle sizes of the inorganic particles are varied as described in Table 3 to prepare the photoreceptor 2-2 through photoreceptor 2-5. The results of evaluation conducted in the same way as in the Example 1 are shown in Table 4.

TABLE 3

| Photo-receptor No. | Lower layer CTL, A(mol) | Upper layer CTL, B(mol) | Inorganic particle | Note (1) |
|---|---|---|---|---|
| 2-1 | TL-1, $9.3 \times 10^{-4}$ | TS-1, $8.3 \times 10^{-4}$ | silica 30 nm | Comp. |
| 2-2 | TL-1, $9.0 \times 10^{-4}$ | TS-1, $5.0 \times 10^{-4}$ | silica 30 nm | Inv. |
| 2-3 | TL-1, $9.3 \times 10^{-4}$ | TS-1, $1.5 \times 10^{-5}$ | silica 30 nm | Comp. |
| 2-4 | TL-1, $8.5 \times 10^{-4}$ | TS-1, $8.1 \times 10^{-4}$ | silica 30 nm | Comp. |
| 2-5 | TL-1, $8.5 \times 10^{-4}$ | TS-1, $5.0 \times 10^{-4}$ | silica 30 nm | Inv. |
| 2-6 | TL-1, $8.5 \times 10^{-4}$ | TS-1, $1.5 \times 10^{-5}$ | silica 30 nm | Comp. |
| 2-9 | TL-1, $3.5 \times 10^{-4}$ | TS-1, $2.1 \times 10^{-5}$ | silica 30 nm | Inv. |
| 2-11 | TL-1, $2.5 \times 10^{-4}$ | TS-1, $3.0 \times 10^{-5}$ | silica 30 nm | Comp. |

TABLE 3-continued

| Photo-receptor No. | Lower layer CTL, A(mol) | Upper layer CTL, B(mol) | Inorganic particle | Note (1) |
|---|---|---|---|---|
| 2-12 | TL-1, $2.5 \times 10^{-4}$ | TS-1, $1.5 \times 10^{-5}$ | silica 30 nm | Comp. |
| 2-13 | TL-1, $3.5 \times 10^{-4}$ | TS-1, $1.5 \times 10^{-5}$ | silica 30 nm | Comp. |

Note (1): Inv. represents one of the example of the invention. Comp. represents comparative example.

TABLE 4

| Photoreceptor No. | Image density | Fog | Image quality | Wore amount μm | Image smear | Note |
|---|---|---|---|---|---|---|
| 1-1 | A | A | B | 0.36 | C | Comp. |
| 2-2 | A | A | B | 0.26 | A | Inv. |
| 2-3 | B | A | C | 0.11 | A | Comp. |
| 2-4 | A | A | B | 0.35 | C | Comp. |
| 2-5 | A | A | A | 0.26 | A | Inv. |
| 2-6 | B | A | C | 0.11 | A | Comp. |
| 2-9 | B | B | B | 0.21 | A | Inv. |
| 2-11 | A | C | B | 0.14 | A | Comp. |
| 2-12 | C | C | C | 0.12 | A | Comp. |
| 2-13 | B | B | B | 0.25 | C | Comp. |

Note (1):
Evaluations of image density, fog, image quality, and wear out amount were done after 50000 copies were made for each photoreceptor.

Example 3

<Preparation of Photoreceptor 3-1>

An aluminum drum having a diameter of 100 mm of the photoreceptor 2-1 was replaced to the aluminum drum having a diameter of 60 mm, further the lower CTL and the upper CTL were prepared with the coating liquid below. Other components and structures were the same as those of the photoreceptor 2-1.

Under Charge Transfer Layer(CTL):

| | |
|---|---|
| Charge transfer material (TL-1) | 675 parts |
| Polycarbonate (EUPILON Z300: made by Mitsubishi Gas Chemical Company, Inc.) | 600 parts |
| THF/toluene (weight ratio: 7/3) | 3000 parts |
| Silicone oil (KF-54: made by Shin-Etu Chemical Co., Ltd.) | 1 part |

The above ingredients were mixed and solved to prepare the under CTL coating liquid 2. This coating liquid was coated on the above-described CGL with dip coating method, dried 70 min. with 110° C., and the under layer of CTL having 15.0 μm dry thickness was formed.

Upper Charge Transfer Layer (CTL):

| | |
|---|---|
| Charge transfer material (TS-1) | 220 parts |
| Polycarbonate (EUPILON Z800: made by Mitsubishi Gas Chemical Company, Inc.) | 600 parts |
| THF/toluene (weight ratio: 7/3) | 3000 parts |
| Silicone oil (KF-54: made by Shin-Etu Chemical Co., Ltd.) | 1 part |
| Inorganic particle(silica particle 30 nm) Surface treatment is applied with methylhydrogen polysiloxane of 5 weight % of the titanium oxide A1) | 50 parts |
| AO agent (AO-1) | 6.6 parts |

The above ingredients were mixed to prepare the upper charge transfer layer coating liquid 2. This coating liquid was coated on the under layer of CTL with circular slide hopper coating method, and the upper layer of CTL having 5.0 μm dry thickness was formed, and the photoreceptor 3-1 was prepared.

<Preparation of the photoreceptor 3-2 through 3-14>

The AO-1 in the upper CTL in the above photoreceptor of Example 3 was replaced as shown by the Table 5, further silica, titanium oxide and alumina that were applied the same surface treatment as in the photoreceptor 3-1 were utilized with the combination shown in the Table 5. The photoreceptors 3-2 through 3-14 were prepared with other components and structures same as those of the photoreceptor 3-1.

Evaluations are conducted by installing the photoreceptors onto a modified model of a full-color multifunctional machine 8050 (made by Konicaminolta Business Technologies Co, Ltd., utilizing a tandem system with intermediate transfer member, and having process speed of 300 mm/sec.), and forming monochromatic and colored images under a high temperature/high humidity condition (30° C., 80% RH). The evaluation items are the same as those of Example 1. Color reproducibility was evaluated for color images. The evaluation results are shown in Table 6.

Evaluation of Color Reproducibility:

The second order colors (red, green, blue) by combinations of Y, M, C toners in solid image area of the first and the $100^{th}$ images are measured by using Macbeth Color-Eye 700. And the color differences between the first image and the $100^{th}$ image are calculated by using CMC (2:1) color difference meter.

A: Color difference is not greater than 2 (Good).

B: Color difference is 2 through 3 (No practical problem).

C: Color difference is greater than 3 (There is a problem, and cannot be practically used).

TABLE 5

| Photo-receptor No. | Lower layer CTL/A (mol) | Upper layer CTL/B (mol) | Inorganic particle | Upper CTL AO agent/ AO amount: Note (2) | Note (1) |
|---|---|---|---|---|---|
| 3-1 | TL-1/ $8.0 \times 10^{-4}$ | TS-1/ $5.0 \times 10^{-4}$ | silica 30 nm | AO-1/3 | Inv. |
| 3-2 | TL-4/ $8.0 \times 10^{-4}$ | TS-9/ $5.0 \times 10^{-4}$ | silica 30 nm | AO-4/3 | Inv. |
| 3-3 | TL-3/ $8.0 \times 10^{-4}$ | TS-3/ $5.0 \times 10^{-5}$ | silica 30 nm | AO-8/3 | Inv. |
| 3-4 | TL-2/ $8.0 \times 10^{-4}$ | TS-5/ $5.0 \times 10^{-4}$ | silica 30 nm | AO-12/3 | Inv. |
| 3-5 | TL-1/ $8.0 \times 10^{-4}$ | TS-6/ $5.0 \times 10^{-4}$ | silica 30 nm | AO-16/3 | Inv. |
| 3-6 | TL-1/ $5.0 \times 10^{-4}$ | TS-1/ $2.0 \times 10^{-4}$ | silica 30 nm | AO-16/0.8 | Inv. |
| 3-7 | TL-1/ $5.0 \times 10^{-4}$ | TS-1/ $2.0 \times 10^{-4}$ | silica 30 nm | AO-16/8 | Inv. |
| 3-8 | TL-1/ $7.0 \times 10^{-4}$ | TS-1/ $1.0 \times 10^{-4}$ | silica 2 nm | AO-16/3 | Comp. |
| 3-9 | TL-1, $7.0 \times 10^{-4}$ | TS-1/ $1.0 \times 10^{-4}$ | silica 180 nm | AO-16/3 | Comp. |
| 3-10 | TL-1/ $7.0 \times 10^{-4}$ | TS-1/ $1.0 \times 10^{-4}$ | silica 6 nm | AO-16/3 | Inv. |
| 3-11 | TL-1/ $7.0 \times 10^{-4}$ | TS-1/ $1.0 \times 10^{-4}$ | silica 95 nm | AO-16/3 | Inv. |
| 3-12 | TL-1/ $7.0 \times 10^{-4}$ | TS-1/ $1.0 \times 10^{-4}$ | silica 30 nm | non | Inv. |
| 3-13 | TL-1/ $5.0 \times 10^{-4}$ | TS-1/ $2.0 \times 10^{-4}$ | $TiO_2$ 50 nm | AO-16/3 | Inv. |
| 3-14 | TL-1/ $5.0 \times 10^{-4}$ | TS-1/ $9.0 \times 10^{-5}$ | Alumina 60 nm | AO-16/3 | Inv. |

Note (1): Part of AO agent amount per 100 parts of CTM weight.

TABLE 6

| Photo-receptor No. | Image density | Fog | Image quality | Wore amount μm | Image smear | Color repro-duci-bility | Note (1) |
|---|---|---|---|---|---|---|---|
| 3-1 | A | A | A | 0.23 | A | B | Inv. |
| 3-2 | A | A | A | 0.23 | A | B | Inv. |
| 3-3 | B | A | A | 0.21 | A | B | Inv. |
| 3-4 | A | A | A | 0.21 | A | B | Inv. |
| 3-5 | A | A | A | 0.22 | A | A | Inv. |
| 3-6 | A | A | A | 0.24 | A | A | Inv. |
| 3-7 | A | A | A | 0.23 | A | A | Inv. |
| 3-8 | B | C | C | 3.01 | C | B | Comp. |
| 3-9 | B | C | C | 0.12 | C | B | Comp. |
| 3-10 | A | A | A | 1.22 | A | A | Inv. |
| 3-11 | A | A | A | 0.25 | A | A | Inv. |
| 3-12 | B | B | B | 0.25 | A | B | Inv. |
| 3-13 | A | A | A | 0.26 | A | A | Inv. |
| 3-14 | A | A | A | 0.27 | A | A | Inv. |

Note (1): Evaluations of image density, fog, image quality, and wear out amount were done after 50000 copies were made for each photoreceptor.

As described above, photoreceptors of this invention are provided with an excellent capability with respect to any of image smear, image density at repeated copies, image quality evaluation and layer thickness wear down characteristics. Further, when AO agent is added, even under the condition of high temperature and high humidity the excellent capabilities are attained, as well as excellent color reproducibility in a high-speed color machine.

This invention can provide; an electrophotographic photoreceptor, which maintains high sensitivity and mechanical strength in a long term usage, without an image smear and deterioration of gas resistance, as well as exhibits stable charging potential; and an image forming method, an image forming apparatus and a process cartridge utilizing the same.

What is claimed is:

1. An electrophotographic photoreceptor comprising a charge generating layer and a charge transfer layer on or over a support, the charge transfer layer including at least two layers of a support side layer and a surface side layer, wherein the support side layer contains A mol/$cm^3$ of a charge transfer material, and the surface side layer contains B mol/$cm^3$ of a charge transfer material having a dipolar moment of not more than 0.75, and inorganic particles having a number average primary particle diameter of 3-150 nm, wherein A and B satisfies relations of (1) and (2), $$9.0\times10^{-4}>A>3.0\times10^{-4} \quad (1)$$

$$8.0\times10^{-4}>B>2.0\times10^{-5} \quad (2)$$

wherein the support side layer comprises at least one of charge transfer materials having chemical structures (TL-1)-(TL-22) and wherein the surface side layer comprises at least one of charge transfer materials having chemical structures (TS-1)-(TS-11):

TL-1
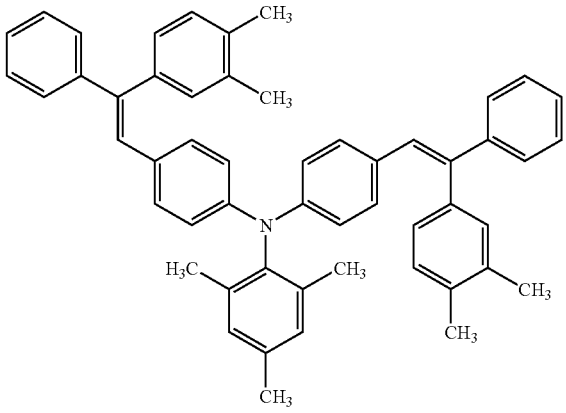
TL-2
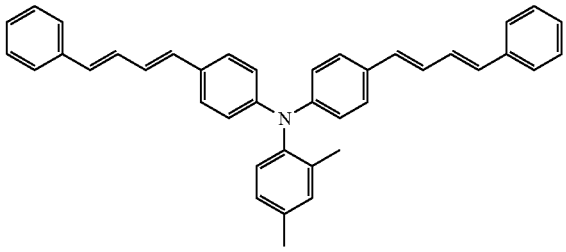
TL-3
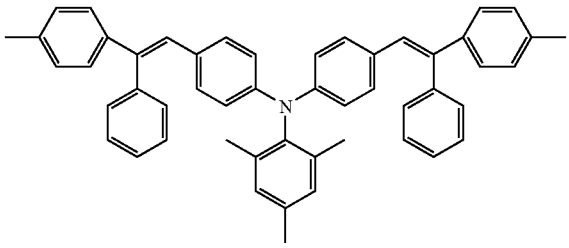
TL-4
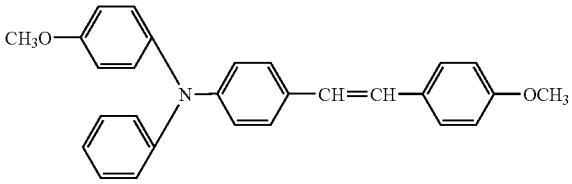
TL-5
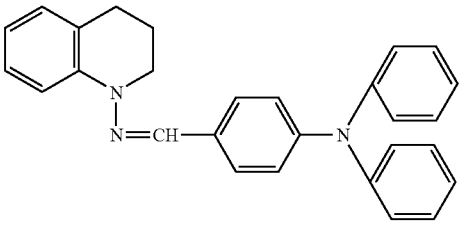
TL-6
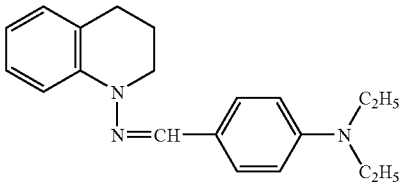
-continued
TL-7
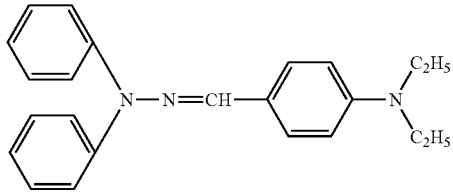
TL-8
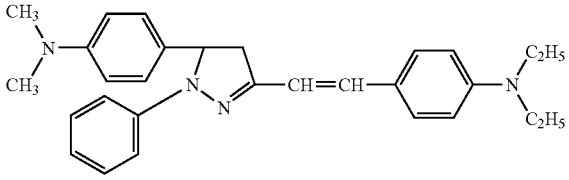
TL-9
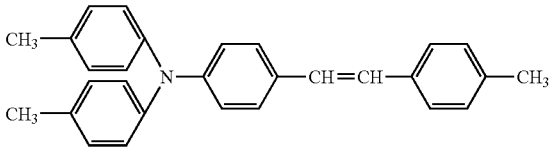
TL-10
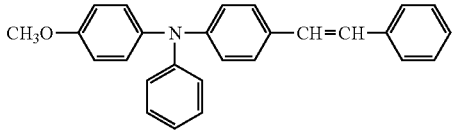
TL-11
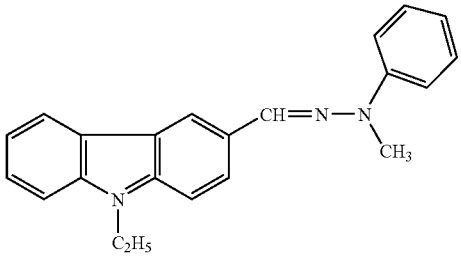
TL-12
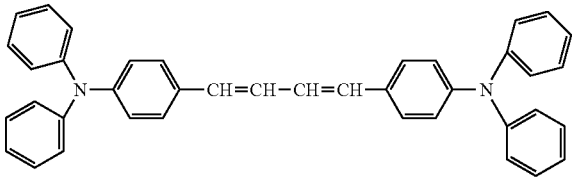
TL-13
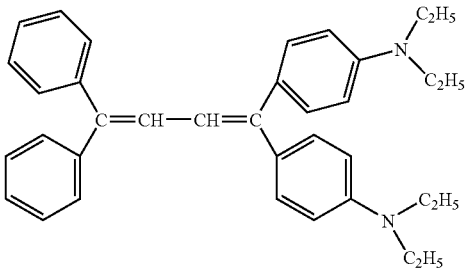

-continued
TL-14
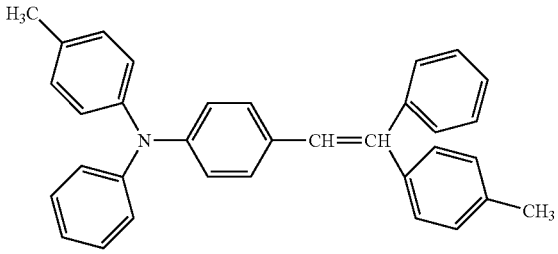
TL-15
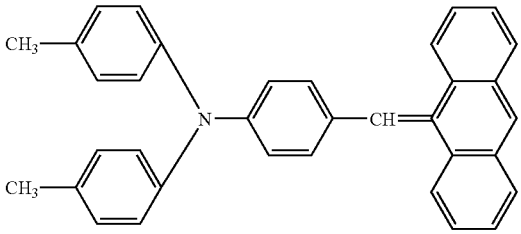
TL-16
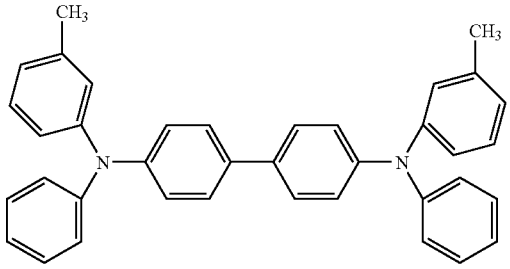
TL-17
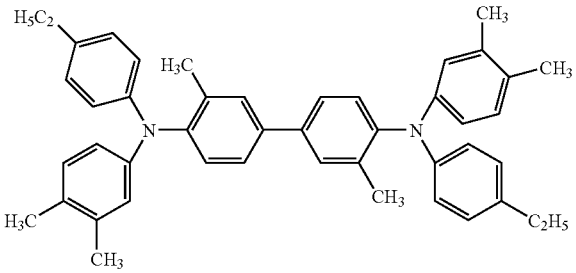
TL-18
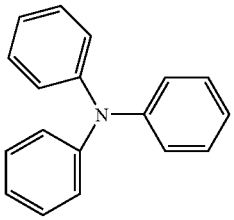
TL-19
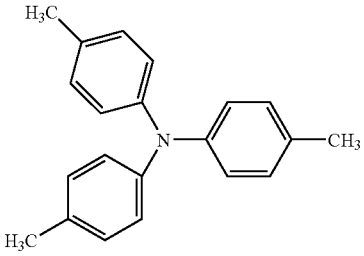
-continued
TL-20
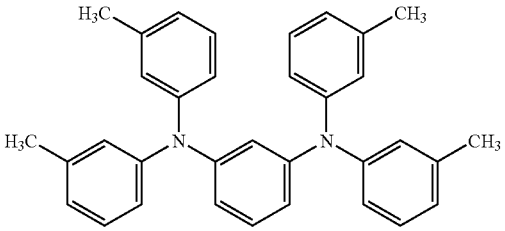
TL-21
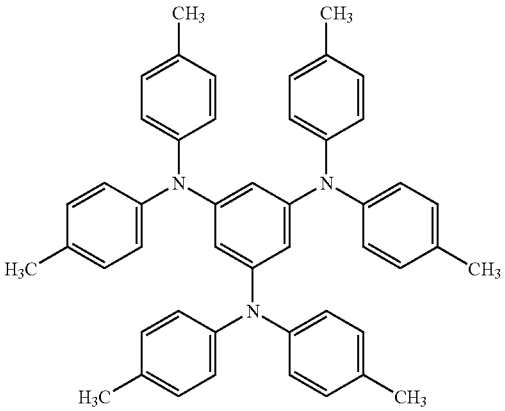
TL-22
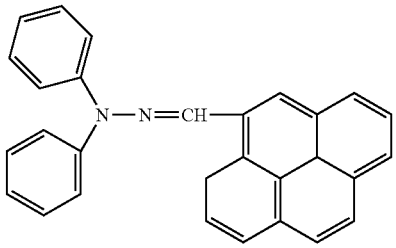
TS-1
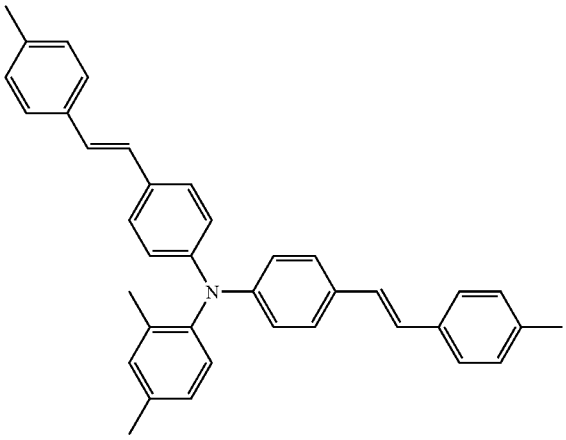

-continued
TS-2
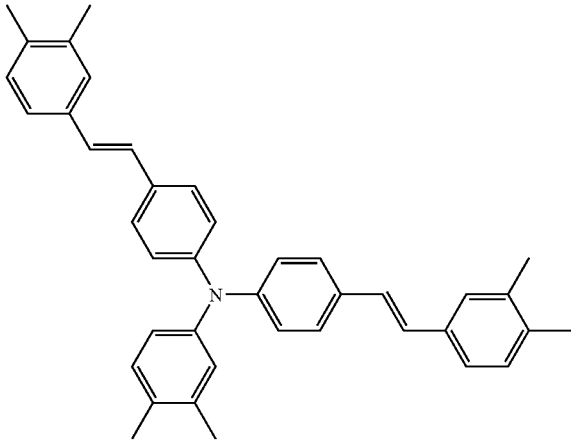
TS-3
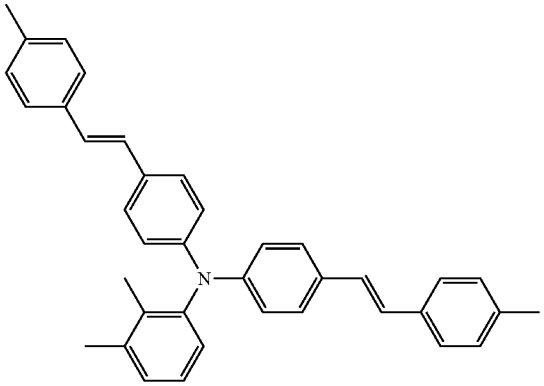
TS-4
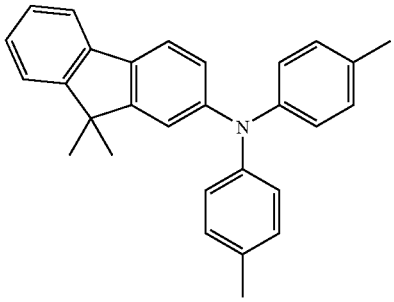
TS-5
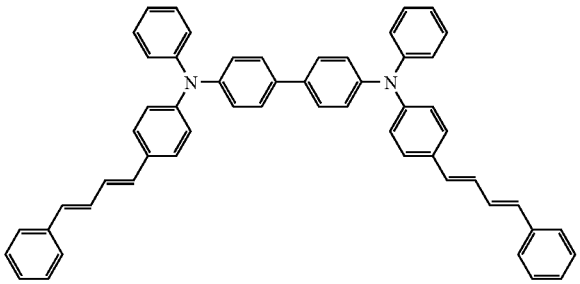
-continued
TS-6
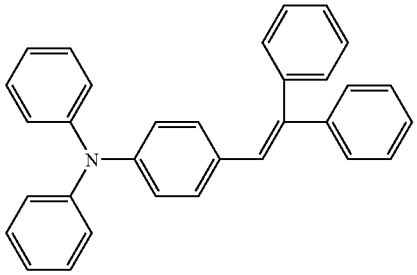
TS-7
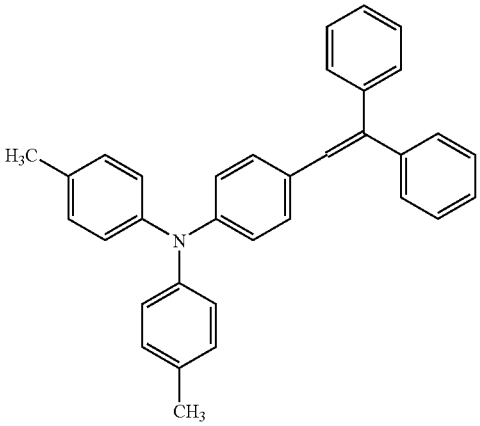
TS-8
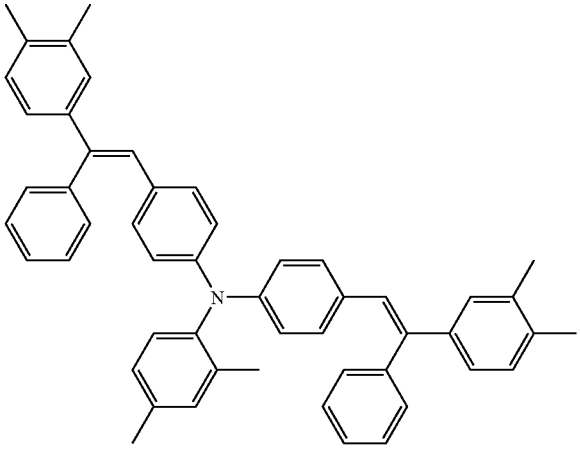
TS-9
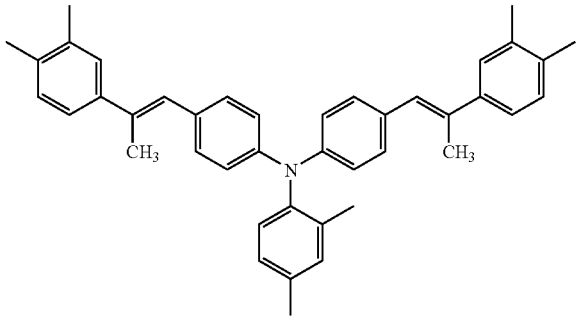

-continued

TS-10

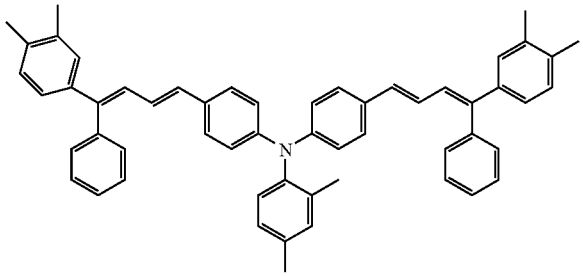

TS-11

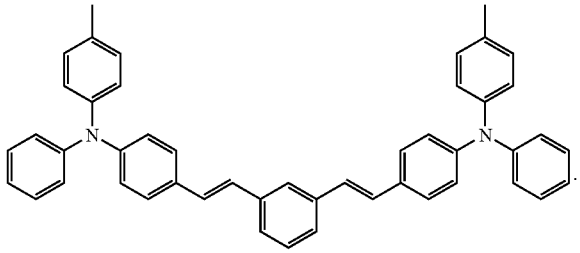

2. The electrophotographic photoreceptor of claim 1, wherein the inorganic particles comprise metal oxide particles.

3. The electrophotographic photoreceptor of claim 2, wherein the inorganic particles comprise titanium oxide particles.

4. The electrophotographic photoreceptor of claim 2, wherein the inorganic particles comprise alumina particles.

5. The electrophotographic photoreceptor of claim 1, wherein the inorganic particles comprise silica particles.

6. The electrophotographic photoreceptor of claim 1, wherein the inorganic particles are applied a surface treatment with a compound containing silicon atom.

7. The electrophotographic photoreceptor of claim 1, wherein an uppermost layer of the charge transfer layer contains an antioxidant.

8. The electrophotographic photoreceptor of claim 1, wherein the charge transfer layer has a thickness from 5 to 50 μm in total.

9. The electrophotographic photoreceptor of claim 8, wherein the inorganic particles having a number average primary particle diameter of 5-100 nm.

10. The electrophotographic photoreceptor of claim 1, wherein the surface side layer comprises a resin represented by general formula [I], and the support side layer comprises at least one of resins represented by the general formulas [II]-[IV]:

General formula (I)

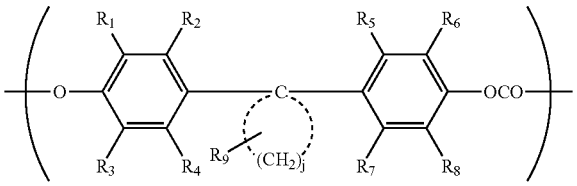

(wherein, $R_1$-$R_8$ represent a hydrogen atom, a halogen atom; an alkyl group, cycloalkyl group or an aryl group, which may be substituted or unsubstituted and having a carbon number of 1-10; j represents an integer of 4-11, and $R_9$ is an alkyl group or an aryl group, having a carbon number of 1-9);

General formula (II)

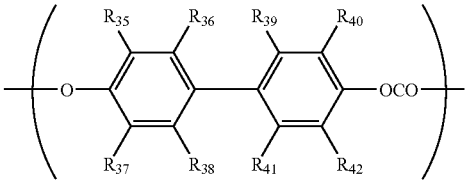

(wherein, $R_{35}$-$R_{42}$ each independently represent a hydrogen atom, a halogen atom, an alkyl group or aryl group);

General formula (III)

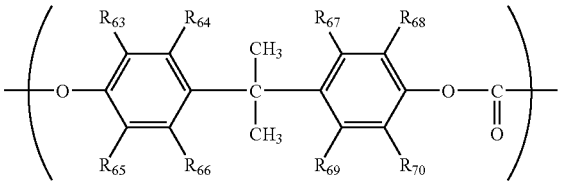

(wherein, $R_{63}$-$R_{70}$ each independently represent a hydrogen atom, a halogen atom; an alkyl group, cycloalkyl group or an aryl group, which may be substituted or unsubstituted and having a carbon number of 1-10);

General formula (IV)

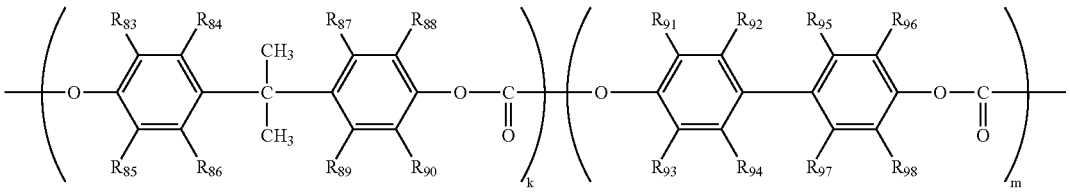

(wherein, $R_{83}$-$R_{98}$ each independently represent a hydrogen atom, a halogen atom; an alkyl group or an aryl group, which may be substituted or unsubstituted; and k and m is a positive integer being selected so as to make k/m of 1-10).

11. An image forming apparatus comprising:

a charging device;

the electrophotographic photoreceptor of claim 1;

an image exposing section; and a developing section to develop an electrostatic latent image formed on the photoreceptor with a developer containing toner.

12. The image forming apparatus of claim 11, wherein the image forming apparatus is capable of forming a full color image.

13. The image forming apparatus of claim 11, wherein the inorganic particles comprise titanium oxide particles, alumina particle or silica particles.

14. The image forming apparatus of claim 11, wherein the charge transfer layer has a thickness from 5 to 50 μm in total.

15. The image forming apparatus of claim 14, wherein the inorganic particles having a number average primary particle diameter of 5-100 nm.

16. The image forming apparatus of claim 11, wherein the surface side layer comprises a resin represented by general formula [I], and the support side layer comprises at least one of resins represented by the general formulas [II]-[IV]:

General formula (I)

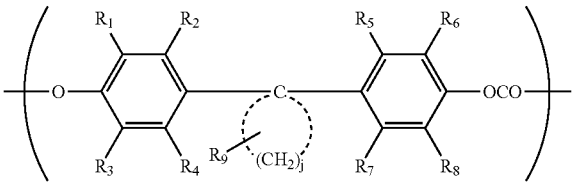

(wherein, $R_1$-$R_8$ represent a hydrogen atom, a halogen atom; an alkyl group, cycloalkyl group or an aryl group, which may be substituted or unsubstituted and having a carbon number of 1-10; j represents an integer of 4-11, and $R_9$ is an alkyl group or an aryl group, having a carbon number of 1-9);

General formula (II)

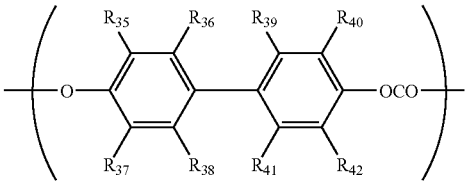

(wherein, $R_{35}$-$R_{42}$ each independently represent a hydrogen atom, a halogen atom, an alkyl group or aryl group);

General formula (III)

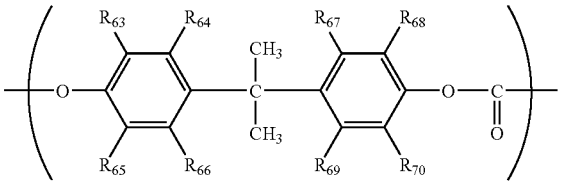

(wherein, $R_{63}$-$R_{70}$ each independently represent a hydrogen atom, a halogen atom; an alkyl group, cycloalkyl group or an aryl group, which may be substituted or unsubstituted and having a carbon number of 1-10);

General formula (IV)

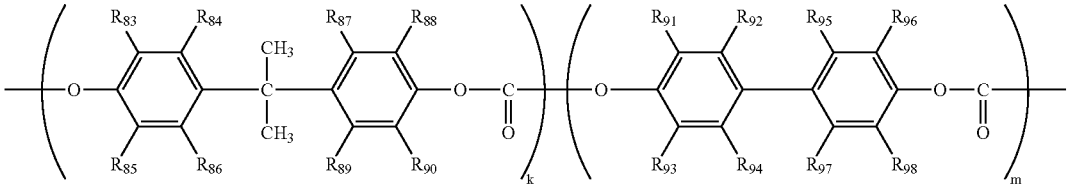

(wherein, $R_{83}$-$R_{98}$ each independently represent a hydrogen atom, a halogen atom; an alkyl group or an aryl group, which may be substituted or unsubstituted; and k and m is a positive integer being selected so as to make k/m of 1-10).

17. A process cartridge for an image forming apparatus which can be installed the process cartridge, the cartridge comprising: the photoreceptor of claim 1, and at least one of a charging device, an exposing device, a developing device and a cleaning device integrally configured with the photoreceptor.

18. The process cartridge of claim 17, wherein the inorganic particles comprise titanium oxide particles, alumina particle or silica particles.

19. The process cartridge of claim 17, wherein the charge transfer layer has a thickness from 5 to 50 μm in total.

20. The process cartridge of claim 17, wherein the inorganic particles having a number average primary particle diameter of 5-100 nm.

* * * * *